US007798225B2

(12) United States Patent
Giroux et al.

(10) Patent No.: US 7,798,225 B2
(45) **Date of Patent: *Sep. 21, 2010**

(54) APPARATUS AND METHODS FOR CREATION OF DOWN HOLE ANNULAR BARRIER

(75) Inventors: Richard Lee Giroux, Cypress, TX (US); Lev Ring, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 114 days.

This patent is subject to a terminal disclaimer.

(21) Appl. No.: 11/462,471

(22) Filed: Aug. 4, 2006

(65) Prior Publication Data

US 2007/0029082 A1 Feb. 8, 2007

Related U.S. Application Data

(60) Provisional application No. 60/705,857, filed on Aug. 5, 2005.

(51) Int. Cl.
*E21B 33/13* (2006.01)

(52) U.S. Cl. ..... 166/285; 166/207; 166/212

(58) Field of Classification Search ..... 166/207, 166/285, 212

See application file for complete search history.

(56) References Cited

U.S. PATENT DOCUMENTS

| | | | |
|---|---|---|---|
| 761,518 | A | 5/1904 | Lykken |
| 1,301,285 | A | 4/1919 | Leonard |
| 1,324,303 | A | 12/1919 | Carmichael |
| 1,542,039 | A | 7/1925 | Deavers |
| 1,561,418 | A | 11/1925 | Duda |
| 1,597,212 | A | 8/1926 | Spengler |
| 1,569,729 | A | 1/1928 | Duda |
| 1,880,218 | A | 10/1932 | Simmons |
| 1,930,825 | A | 10/1933 | Raymond |
| 1,981,525 | A | 11/1934 | Price |
| 2,214,225 | A | 9/1940 | Drummond |
| 2,214,226 | A | 9/1940 | English |
| 2,383,214 | A | 8/1945 | Prout |
| 2,499,630 | A | 3/1950 | Clark |

(Continued)

FOREIGN PATENT DOCUMENTS

| | | |
|---|---|---|
| EP | 0 353 309 | 2/1990 |

(Continued)

OTHER PUBLICATIONS

GB Search Report, Application No. GB0615625.1, dated Nov. 27, 2006.

(Continued)

*Primary Examiner*—Daniel P Stephenson
(74) *Attorney, Agent, or Firm*—Patterson & Sheridan, LLP

(57) ABSTRACT

Methods and apparatus are provided for performing an expedited shoe test using an expandable casing portion as an annular fluid barrier. Further provided are methods and apparatus for successfully recovering from a failed expansion so that a shoe test can be completed without replacement of the expandable casing portion. In one recovery method, a selectively actuatable fluid circulation tool is provided to further expand the expandable portion or perform a cementing operation. Additionally, methods and apparatus are provided to drill a wellbore and form an annular fluid barrier in a single trip.

28 Claims, 13 Drawing Sheets

U.S. PATENT DOCUMENTS 2,519,116 A 8/1950 Crake
2,627,891 A 2/1953 Clark
2,683,073 A 7/1954 Pierce
2,898,971 A 8/1959 Hempel
3,028,915 A 4/1962 Jennings
3,087,546 A 4/1963 Woodlley
3,186,485 A 6/1965 Owen
3,195,646 A 7/1965 Brown
3,203,483 A 8/1965 Vincent
3,245,471 A 4/1966 Howard
3,297,092 A 1/1967 Jennings
3,326,293 A 6/1967 Skipper
3,353,599 A 11/1967 Swift
3,354,955 A 11/1967 Berry
3,467,180 A 9/1969 Pensotti
3,477,506 A 11/1969 Malone
3,489,220 A 1/1970 Kinley
3,498,376 A 3/1970 Sizer et al.
3,545,543 A 12/1970 Kammerer, Jr. et al.
3,669,190 A 6/1972 Sizer et al.
3,691,624 A 9/1972 Kinley
3,746,091 A 7/1973 Owen et al.
3,776,307 A 12/1973 Young
3,780,562 A 12/1973 Kinley
3,785,193 A 1/1974 Kinley et al.
3,818,734 A 6/1974 Bateman
3,911,707 A 10/1975 Minakov et al.
4,069,573 A 1/1978 Rogers, Jr. et al.
4,127,168 A 11/1978 Hanson et al.
4,159,564 A 7/1979 Cooper, Jr.
4,288,082 A 9/1981 Setterberg, Jr.
4,324,407 A 4/1982 Upham et al.
4,359,889 A 11/1982 Kelly
4,414,739 A 11/1983 Kelly
4,429,620 A 2/1984 Burkhardt et al.
4,450,612 A 5/1984 Kelly
4,502,308 A 3/1985 Kelly
4,531,581 A 7/1985 Pringle et al.
4,567,631 A 2/1986 Kelly
4,588,030 A 5/1986 Blizzard
4,697,640 A 10/1987 Szarka
4,848,469 A 7/1989 Baugh et al.
4,976,322 A 12/1990 Abdrakhmanov et al.
5,014,779 A 5/1991 Meling et al.
5,031,699 A 7/1991 Artynov et al.
5,052,483 A 10/1991 Hudson
5,083,608 A 1/1992 Abdrakhmanov et al.
5,271,472 A 12/1993 Leturno
5,322,127 A 6/1994 McNair et al.
5,337,823 A 8/1994 Nobileau
5,348,095 A 9/1994 Worrall et al.
5,388,648 A 2/1995 Jordan, Jr.
5,409,059 A 4/1995 McHardy
5,435,400 A 7/1995 Smith
5,472,057 A 12/1995 Winfree
5,560,426 A 10/1996 Trahan et al.
5,667,011 A 9/1997 Gill et al.
5,685,369 A 11/1997 Ellis et al.
5,785,120 A 7/1998 Smalley et al.
5,787,984 A 8/1998 Mabile
5,794,702 A 8/1998 Nobileau
5,901,787 A 5/1999 Boyle
5,957,195 A 9/1999 Bailey et al.
5,979,560 A 11/1999 Nobileau
6,021,850 A 2/2000 Wood et al.
6,070,671 A 6/2000 Cumming et al.
6,073,692 A 6/2000 Wood et al.
6,085,838 A 7/2000 Vercaemer et al.
6,098,717 A 8/2000 Bailey et al.
6,135,208 A 10/2000 Gano et al.
6,138,751 A 10/2000 Hart
6,138,761 A 10/2000 Freeman et al.
6,142,230 A 11/2000 Smalley et al.
6,253,852 B1 7/2001 Nobileau
6,325,148 B1 12/2001 Trahan et al.
6,328,113 B1 12/2001 Cook
6,354,373 B1 3/2002 Vercaemer et al.
6,425,444 B1 7/2002 Metcalfe et al.
6,431,282 B1 * 8/2002 Bosma et al. ..... 166/288
6,446,323 B1 9/2002 Metcalfe et al.
6,446,724 B2 9/2002 Baugh et al.
6,454,013 B1 9/2002 Metcalfe
6,457,532 B1 10/2002 Simpson
6,457,533 B1 10/2002 Metcalfe
6,470,966 B2 10/2002 Cook et al.
6,513,588 B1 2/2003 Metcalfe
6,527,049 B2 3/2003 Metcalfe et al.
6,543,552 B1 4/2003 Metcalfe et al.
6,543,816 B1 4/2003 Noel
6,571,871 B2 6/2003 Lauritzen et al.
6,578,630 B2 6/2003 Simpson et al.
6,629,568 B2 10/2003 Post et al.
6,688,397 B2 2/2004 McClurkin et al.
6,702,029 B2 3/2004 Metcalfe et al.
6,708,767 B2 3/2004 Harrall et al.
6,712,151 B2 3/2004 Simpson et al.
6,712,401 B2 3/2004 Coulon et al.
6,722,451 B2 4/2004 Saugier
6,725,934 B2 4/2004 Coronado et al.
6,742,598 B2 6/2004 Whitelaw et al.
6,854,522 B2 2/2005 Brezinski et al.
6,860,329 B1 3/2005 Oosterling
6,868,905 B2 3/2005 Lauritzen et al.
6,907,937 B2 6/2005 Whanger et al.
6,976,536 B2 12/2005 Simpson et al.
7,017,670 B2 3/2006 Hazel et al.
7,028,780 B2 4/2006 Maguire
7,063,149 B2 6/2006 Simpson et al.
7,086,480 B2 8/2006 Simpson et al.
7,090,024 B2 8/2006 Simpson et al.
7,090,025 B2 8/2006 Haugen et al.
7,104,322 B2 9/2006 Whanger et al.
7,121,351 B2 10/2006 Luke et al.
7,124,829 B2 10/2006 Braddick
7,152,679 B2 12/2006 Simpson
7,152,684 B2 * 12/2006 Harrall et al. ..... 166/380
7,204,306 B2 4/2007 Abdrakhmanov et al.
7,350,584 B2 4/2008 Simpson et al.
7,350,585 B2 4/2008 Simpson et al.
7,475,723 B2 1/2009 Ring, et al.
2002/0108756 A1 8/2002 Harrall et al.
2002/0166664 A1 11/2002 Lauritzen et al.
2003/0037931 A1 2/2003 Coon
2003/0106688 A1 6/2003 Saugier
2003/0150608 A1 8/2003 Smith, Jr. et al.
2003/0168222 A1 9/2003 Maguire et al.
2003/0205386 A1 11/2003 Johnston et al.
2003/0230410 A1 12/2003 Underhill
2004/0020659 A1 2/2004 Hall et al.
2004/0020660 A1 2/2004 Johnson et al.
2004/0045616 A1 3/2004 Cook et al.
2004/0079528 A1 4/2004 Metcalfe et al.
2004/0140103 A1 7/2004 Steele et al.
2004/0159446 A1 8/2004 Haugen et al.
2004/0173360 A1 9/2004 Harrall et al.
2004/0177953 A1 9/2004 Wubben
2004/0262014 A1 12/2004 Cook et al.
2005/0045342 A1 3/2005 Luke et al.
2005/0161213 A1 7/2005 Sonnier et al.
2005/0217865 A1 10/2005 Ring
2005/0269107 A1 12/2005 Cook et al.

2006/0076147 A1 4/2006 Ring

FOREIGN PATENT DOCUMENTS

| | | |
|---|---|---|
| EP | 0 397 870 | 11/1990 |
| EP | 0 397 874 | 11/1990 |
| EP | 0 961 007 | 12/1999 |
| GB | 1 485 099 | 9/1977 |
| GB | 2 086 282 | 5/1982 |
| GB | 2 320 734 | 7/1998 |
| GB | 2 374 101 | 10/2002 |
| GB | 2 383 361 | 6/2003 |
| GB | 2 388 130 | 11/2003 |
| GB | 2 388 137 | 11/2003 |
| GB | 2 401 131 | 11/2004 |
| GB | 2 442 393 | 4/2008 |
| RU | 1239363 | 11/1994 |
| RU | 1 367 586 | 11/1996 |
| RU | 2 079 633 | 5/1997 |
| RU | 2 083 798 | 7/1997 |
| RU | 2 187 619 | 8/2002 |
| SU | 1239363 | 11/1984 |
| SU | 1813171 | 7/1991 |
| SU | 1 745 873 | 7/1992 |
| WO | WO 84/00120 | 1/1984 |
| WO | WO 93/24728 | 12/1993 |
| WO | WO 95/03476 | 2/1995 |
| WO | WO 98/00626 | 1/1998 |
| WO | WO 99/18328 | 5/1999 |
| WO | WO 99/23354 | 5/1999 |
| WO | WO 99/35368 | 7/1999 |
| WO | WO 00/31375 | 6/2000 |
| WO | WO 00/37766 | 6/2000 |
| WO | WO 00/37771 | 6/2000 |
| WO | WO 00/61914 | 10/2000 |
| WO | WO 01/18354 | 3/2001 |
| WO | WO 01/38693 | 5/2001 |
| WO | WO 01/98623 | 12/2001 |
| WO | WO 02/29199 | 4/2002 |
| WO | WO 02/053867 | 7/2002 |
| WO | WO 02/059456 | 8/2002 |
| WO | WO 02/066783 | 8/2002 |
| WO | WO 03/006788 | 1/2003 |
| WO | WO 03/029607 | 4/2003 |
| WO | WO 03/036018 | 5/2003 |
| WO | WO 03/042487 | 5/2003 |
| WO | WO 03/048525 | 6/2003 |
| WO | WO 03/071086 | 8/2003 |
| WO | WO 03/083258 | 10/2003 |
| WO | WO 03/102365 | 12/2003 |
| WO | WO 2004/022913 | 3/2004 |
| WO | WO 2005/003511 | 1/2005 |

OTHER PUBLICATIONS

PCT Examination Report for Application No. GB0615625.1 dated Apr. 24, 2009.

GB Examination Report for Application No. GB0615625.1 dated Dec. 11, 2009.

PCT Search Report for International Application No. PCT/US2006/028325 dated Nov. 21, 2006.

Canadian Office Action for Application No. 2,555,563 dated Sep. 10, 2007.

Office Action for U.S. Appl. No. 11/459,264 dated Sep. 28, 2007.

GB Examination Report for Application No. GB0615625.1 dated Mar. 2, 2010.

* cited by examiner

FIG. 5
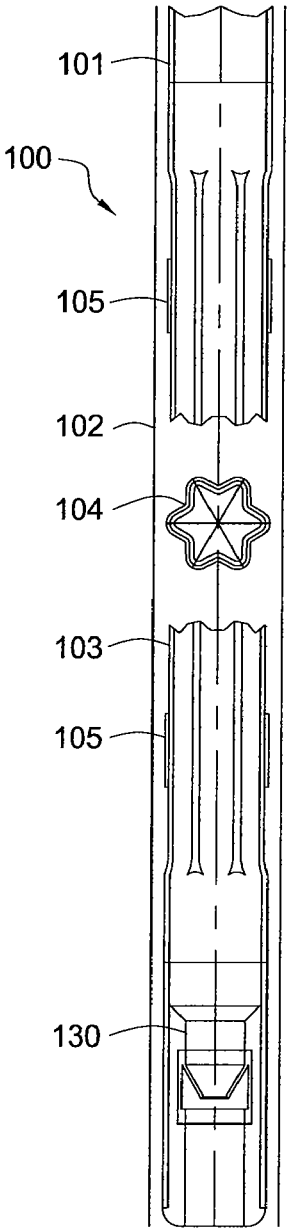
FIG. 6
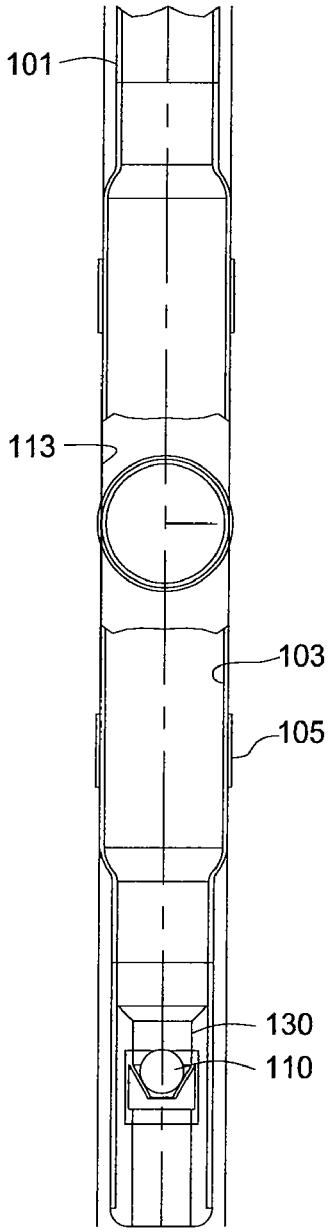
FIG. 7
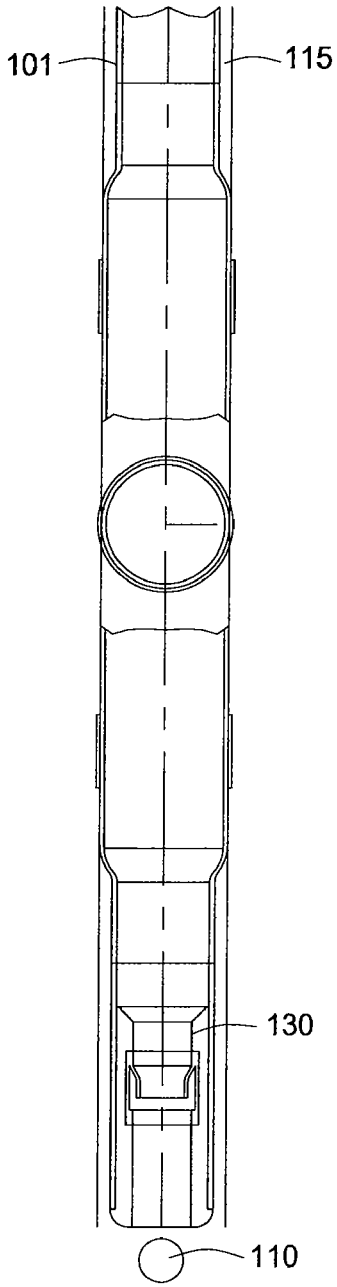
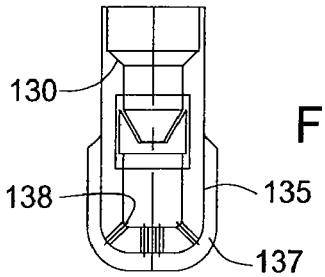
FIG. 8

FIG. 9
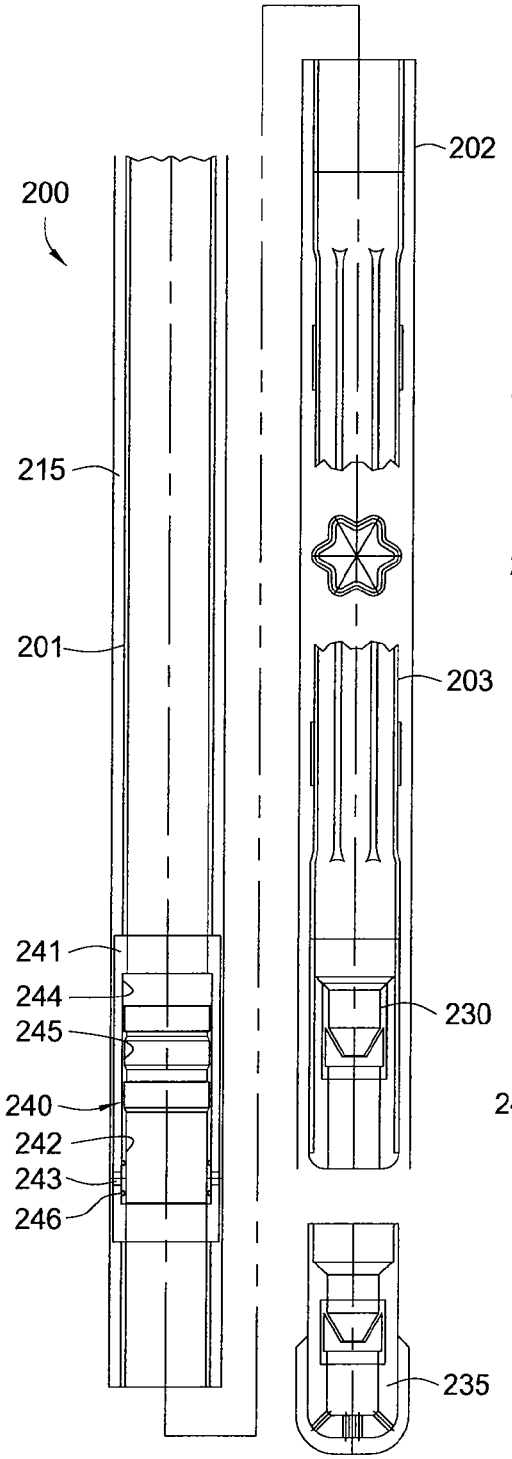
FIG. 10
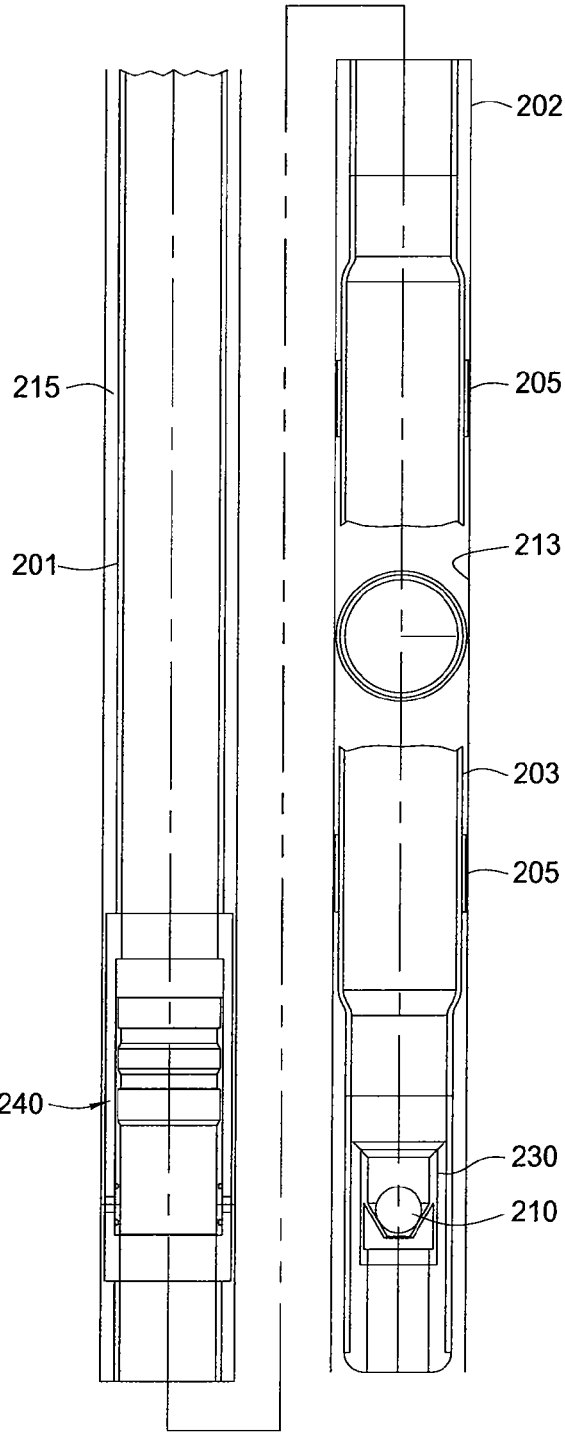
FIG. 9A

APPARATUS AND METHODS FOR CREATION OF DOWN HOLE ANNULAR BARRIER

CROSS-REFERENCE TO RELATED APPLICATION

This application claims benefit of U.S. Provisional Patent Application Ser. No. 60/705,857, filed on Aug. 5, 2005, which application is incorporated herein by reference in its entirety.

BACKGROUND OF THE INVENTION

1. Field of the Invention

Embodiments of the invention generally relate to methods and apparatus for creating an annular barrier in a wellbore. More particularly, embodiments of the invention relates to methods and apparatus for isolating at least a portion of a wellbore from at least another portion of the wellbore.

2. Description of the Related Art

As part of the wellbore construction process, a hole or wellbore is typically drilled into the earth and then lined with a casing or liner. Sections of casing or liner are threaded together or otherwise connected as they are run into the wellbore to form what is referred to as a "string." Such casing typically comprises a steel tubular good or "pipe" having an outer diameter that is smaller than the inner diameter of the wellbore. Because of the differences in those diameters, an annular area occurs between the inner diameter of the wellbore and the outer diameter of the casing and absent anything else, wellbore fluids and earth formation fluids are free to migrate lengthwise along the wellbore in that annular area.

Wells are typically constructed in stages. Initially a hole is drilled in the earth to a depth at which earth cave-in or wellbore fluid control become potential issues. At that point, drilling is stopped and casing is placed in the wellbore. While the casing may structurally prevent cave-in, it will not prevent fluid migration along a length of the well in the annulus. For that reason, the casing is typically cemented in place. To accomplish that, a cement slurry is pumped down through the casing and out the bottom of the casing. Drilling fluid, water, or other suitable wellbore fluid is pumped behind the cement slurry in order to displace the cement slurry into the annulus. Typically, drillable wiper plugs are used to separate the cement from the wellbore fluid in advance of the cement volume and behind it. The cement is left to cure in the annulus thereby forming a barrier to fluid migration within the annulus. After the cement has cured, the cured cement remaining in the interior of the casing is drilled out and the cement seal or barrier between the casing and the formation is pressure tested. If the pressure test is successful, a drill bit is then run through the cemented casing and drilling is commenced from the bottom of that casing. A new length of hole is then drilled, cased, and cemented. Depending on the total length of well, several stages may be drilled and cased as described.

As previously mentioned, the cement barrier is tested between each construction stage to ensure that a fluid tight annular seal has been achieved. Typically, the barrier test is performed by applying pressure to the casing internally, which typically involves pumping fluid into the casing string from the surface. The pressure exits the bottom of the casing and bears on the annular cement barrier. The pressure is then monitored at the surface for leakage. Such testing is often referred to as a "shoe test" where the word "shoe" indicates the lowermost portion or bottom of a given casing string. When another well section is needed below a previously cased section, it is important that a successful shoe test be completed before progressing with the drilling operation.

Unfortunately, cementing operations require cessation of drilling operations for considerable periods of time. Time is required to mix the cement and then to pump it downhole. Additional time is required to allow the cement to cure once it is in place. During the cementing operations drilling rig costs and other fixed costs still accrue yet no drilling progress is made. Well construction is typically measured in feet per day. Fixed costs such as the drilling rig costs, which are charged on a per day basis, are translated to dollars per foot. Because cementing takes time with zero feet drilled, the cementing operation merely increases the dollar per foot metric. Therefore, it is beneficial to minimize or eliminate such "zero feet drilled" steps in order to decrease the average dollar per foot calculation associated with well construction costs.

Expandable wellbore pipe has been used for a variety of well construction purposes. Such expandable pipe is typically expanded mechanically by means of some type of swage or roller device. An example of expandable casing is shown in U.S. Pat. No. 5,348,095, which is incorporated by reference herein in its entirety. Such expandable casing has been described in some embodiments as providing an annular fluid barrier when incorporated as part of a casing string.

Expandable pipe has also been shown having non-circular ("folded") pre-expanded cross-sections. Such initially non-circular pipe is shown to assume a substantially circular cross-section upon expansion. Such pipe may have substantially the same cross-sectional perimeter before and after expansion, i.e., where the expansion comprises a mere "unfolding" of the cross-section. Other such pipe has been shown wherein the cross-section is "unfolded" and its perimeter increased during the expansion process. Such non-circular pipes can be expanded mechanically or by application of internal pressure or by a combination of the two. An example of "folded" expandable pipe is shown in U.S. Pat. No. 5,083,608, which is incorporated by reference herein in its entirety.

As mentioned above, mechanical pipe expansion mechanisms include swage devices and roller devices. An example of a swage type expander device is shown in U.S. Pat. No. 5,348,095, which is incorporated by reference herein in its entirety. An example of a roller type expander device is shown in U.S. Pat. No. 6,457,532, which patent is incorporated by reference herein in its entirety. U.S. Pat. No. 6,457,532 also shows a roller type expander having compliant characteristics that allow it to "form fit" an expandable pipe to an irregular surrounding surface such as that formed by a wellbore. Such form fitting ensures better sealing characteristics between the outer surface of the pipe and the surrounding surface.

Expandable pipe has been shown and described having various exterior coatings or elements thereon to augment any annular fluid barrier created by the pipe. Elastomeric elements have been described for performing such function. Coated expandable pipe is shown in U.S. Pat. No. 6,789,622 and that patent is incorporated by reference herein in its entirety.

Regardless of whether or not the cross-section is initially circular or is folded, expandable pipe has limitations of expandability based on the expansion mechanism chosen. When expandable pipe is deployed for the purpose of creating an annular fluid barrier, the initial configuration of the pipe and the expansion mechanism used must be carefully tailored to a given application to ensure that the expansion is sufficient to create a barrier. If the chosen expansion mechanism is miscalculated in a given circumstance, the result can be extremely disadvantageous. In such a situation, the expanded pipe is not useful as a barrier and further, because the pipe has been expanded or partially expanded, retrieval may be impractical. Remedying such a situation consumes valuable rig time and accrues other costs associated with remediation equipment and replacement of the failed expandable pipe.

Therefore, a need exists for improved methods and apparatus for creating an annular barrier proximate a casing shoe that eliminates the necessity for cementing. There further exists a need for improved methods and apparatus for creating an annular fluid barrier using expandable pipe that provides for a successful recovery from a failed expansion attempt.

SUMMARY OF THE INVENTION

The invention generally relates to methods and apparatus for performing an expedited shoe test using an expandable casing portion as an annular fluid barrier. Such an expandable annular fluid barrier may be used in conjunction with cement if so desired but cement is not required. Further provided are methods and apparatus for successfully recovering from a failed expansion so that a shoe test can be completed without replacement of the expandable casing portion.

In one embodiment, a casing or liner string is lowered into a wellbore, wherein the casing or liner string includes a non-circular or "folded" expandable portion proximate a lower end of the string. The expandable portion includes at least a section having a coating of elastomeric material about a perimeter thereof. The lowermost portion of the string includes a ball seat. While the string is being lowered, fluid can freely enter the string through the ball seat to fill the string. When the string reaches the desired location in the wellbore, a ball is dropped from the surface of the earth into the interior of the string. The ball subsequently locates in the ball seat. When located in the ball seat, the ball seals the interior of the string so that fluid cannot exit there from. Pressure is applied, using fluid pumps at the surface, to the interior of the string thereby exerting internal pressure on the folded expandable portion. At a predetermined pressure, the folded expandable portion unfolds into a substantially circular cross-section having a diameter larger than the major cross-sectional axis of the previously folded configuration. Such "inflation" of the folded section presses the elastomeric coating into circumferential contact with the wellbore therearound, thereby creating an annular seal between the string and the wellbore. The ball is now retrieved from the ball seat and withdrawn from the interior of the string by suitable means such as a wireline conveyed retrieval tool. Alternatively, pressure may be increased inside the string until the ball plastically deforms the ball seat and is expelled from the lower end of the string. Pressure is then applied to the interior of the string and held for a period of time while monitoring annular fluid returns at the surface. If such pressure holds, then the cementless shoe test has been successful.

If the above described shoe test pressure doesn't hold and fluid returns are evident from the annulus, then a recovery phase is required. A rotary expansion tool is lowered on a work pipe string through the interior of the casing string until the rotary expansion tool is located proximate the unfolded section of expandable casing. The rotary expansion tool is activated by fluid pressure applied to the interior of the work string. The work string is then rotated and translated axially along the unfolded section of expandable casing thereby expanding that unfolded section into more intimate contact with the wellbore there around. Following that secondary expansion, the work string and expansion tool are withdrawn from the casing. A second shoe test may now be performed as previously described.

Optionally, cement may be used in conjunction with the expandable casing portion to add redundancy to the fluid barrier seal mechanism. In such an embodiment, a casing or liner string is lowered into a wellbore, wherein the casing or liner string includes a non-circular or "folded" expandable portion proximate a lower end of the string. The expandable portion includes at least a section having a coating of elastomeric material about a perimeter thereof. The lowermost portion of the string includes a ball seat. While the string is being lowered fluid can freely enter the string through the ball seat to fill the string. When the string reaches the desired location in the wellbore a volume of cement sufficient to fill at least a portion of the annulus between the casing and the wellbore, is pumped through the interior of the casing, out the lower end and into the annulus adjacent the lower end including the expandable portion. A ball is then dropped from the surface of the earth into the interior of the string. The ball subsequently locates in the ball seat. When located in the ball seat, the ball seals the interior of the string so that fluid cannot exit there from. Pressure is applied, using fluid pumps at the surface, to the interior of the string thereby exerting internal pressure on the folded expandable portion. At a predetermined pressure, the folded expandable unfolds into a substantially circular cross-section having a diameter larger than the major cross-sectional axis of the previously folded configuration. Such "inflation" of the folded section presses the elastomeric coating into circumferential contact with the cement and wellbore therearound, thereby creating an annular seal between the string and the wellbore. The ball is now retrieved from the ball seat and withdrawn from the interior of the string by suitable means such as a wireline conveyed retrieval tool. Alternatively, pressure may be increased inside the string until the ball plastically deforms the ball seat and is expelled from the lower end of the string. Pressure can now be applied to the interior of the string and held for a period of time while monitoring annular fluid returns at the surface. If such pressure holds then the cement enhanced shoe test has been successful.

In another embodiment, a method for creating and testing an annular barrier includes drilling a wellbore; lowering a tubular into the wellbore, the tubular including an expandable portion proximate a lower end thereof; and expanding the expandable portion into a substantially sealing engagement with the wellbore. The method further includes applying a pressure to a first side of the sealing engagement between expandable portion and the wellbore and monitoring a second side of the sealing engagement for a change in pressure.

In another embodiment, a method for creating and testing an annular barrier includes drilling a wellbore; lowering a tubular into the wellbore, the tubular including an expandable portion proximate a lower end thereof; expanding the expandable portion into a substantially sealing engagement with the wellbore; and supplying cement through a selectively actuatable fluid circulation tool. In yet another embodiment, the method further includes applying a pressure to a first side of the sealing engagement between expandable portion and the wellbore and monitoring a second side of the sealing engagement for a change in pressure.

In another embodiment, a casing or liner string is lowered into a wellbore, wherein the casing or liner string includes a non-circular or "folded" expandable portion proximate a lower end of the string. The expandable portion includes at least a section having a coating of elastomeric material about a perimeter thereof. A ball seat is disposed at the lowermost portion of the string, and a port collar is disposed above the expandable portion. While the string is being lowered, fluid can freely enter the string through the ball seat to fill the string. When the string reaches the desired location in the wellbore, a ball is dropped from the surface of the earth into the interior of the string. The ball subsequently locates in the ball seat, thereby sealing the interior of the string so that fluid cannot exit there from. Pressure is applied to unfold the folded expandable portion into a substantially circular cross-section having a diameter larger than the major cross-sectional axis of the previously folded configuration. Such "inflation" of the folded section presses the elastomeric coating into circumferential contact with the wellbore therearound, thereby creating an annular seal between the string and the wellbore. Then, pressure is increased inside the string until the ball plastically deforms the ball seat and is expelled from the lower end of the string. A pressure test is conducted by applying pressure to the interior of the string and holding the pressure for a period of time while monitoring annular fluid returns at the surface. If such pressure holds, then the cementless shoe test has been successful.

If the shoe test pressure doesn't hold and fluid returns are evident from the annulus, then a recovery phase is required. In one embodiment, the recovery phase includes further expansion of any unfolded section of the expandable portion. A rotary expansion tool is activated by fluid pressure applied to the interior of the work string. The work string is then rotated and translated axially along the unfolded section of expandable casing thereby expanding that unfolded section into more intimate contact with the wellbore therearound. Following the secondary expansion, the work string and expansion tool are withdrawn from the casing. A second shoe test may now be performed as previously described.

Alternatively, the recovery phase includes supplying cement to the annulus to add redundancy to the fluid barrier seal mechanism. An inner string having a port collar operating tool and a stinger is lowered into the casing. The stinger engages the ball seat to close off fluid communication through the casing. Fluid pressure is supply to the interior of the expandable portion to expand any unfolded sections. Thereafter, the stinger is disengaged with ball seat to reestablish fluid communication with the casing. A second pressure test may now be performed as previously described.

If the second shoe test pressure indicates a leak, then a cementing operation is may be performed. Initially, a dart is pumped down the inner string to close off the ports above the stinger. Then, the port collar operating tool is actuated to open the port collar. Cement is then supplied through the inner string, out the port collar, and into the annulus. The port collar is closed after cementing. Thereafter, the casing is reversed circulated to remove any excess cement. A circulation valve above the port collar operating tool is opened before the inner string is removed to allow the pulling of a "dry" string. A drill string may now be lowered to drill out the extrudable ball seat and drill ahead to form the next wellbore section.

In another embodiment, a casing or liner string includes an expandable portion proximate a lower end of the string and at least a section having a coating of elastomeric material about a perimeter thereof. A dart seat is disposed at the lowermost portion of the string, and a float collar is disposed above the expandable portion. An inner string connects the float collar and the dart seat, thereby defining an annular area between the inner string and the casing string. The annular area may be filled with an incompressible or high viscosity fluid. To seal the wellbore annulus, cement is pumped through the float collar, out the casing string, and into the annulus. A dart is pumped behind the cement and seats in the dart seat, thereby closing fluid communication through the casing string. Fluid pressure is applied through a port in the inner string to exert pressure against the interior of the casing. The applied pressure unfolds the folded the expandable portion into a substantially circular cross-section. Such "inflation" of the folded section presses the elastomeric coating into circumferential contact with the wellbore therearound, thereby creating an annular seal between the string and the wellbore. Then, pressure is increased until the dart seat detaches from the shoe and is expelled from the lower end of the string. Thereafter, pressure in the string is decreased to close the float collar. After the cement sets, a drill string can be lowered to drill out the float collar, inner string, and the shoe, and drill ahead to form the next wellbore section.

In another embodiment, a casing or liner string includes a stage tool, a folded unexpanded expandable portion, and a ball seat shoe. After positioning the expandable portion at the desired location, a ball is place into the string and subsequently locates in the ball seat. When located in the ball seat, the ball seals the interior of the string and prevents fluid from flowing out of the string. Sufficient pressure is applied to unfold the expandable portion and press the elastomeric seals against the wellbore wall. After expansion, additional pressure is applied to break a rupturable disk in the stage tool for fluid communication with the annulus. Cement is pumped down the casing string and out into the annulus. The closing plug behind the cement lands on the stage tool, thereby closing fluid communication with the annulus. After the cement sets, a drill string can be lowered to drill out the stage tool and the ball seat shoe and drill ahead to form the next wellbore section.

In another embodiment, a drill shoe may replace the shoe disposed at the lower portion of the string. In this respect, only a single trip is required to drill the wellbore and seal the annulus.

In another embodiment, the casing or liner string may include one or more expandable portions disposed along its length. The one or more expandable portions may be arranged in any suitable order necessary to perform the desired task.

In another embodiment, the casing or liner string having at least one expandable portion may be used to line a wellbore. Particularly, the casing or liner string may be used to re-line an existing wellbore. For example, the casing or liner string may be positioned adjacent the existing wellbore such that the seal regions on the casing or liner string straddle the section of the wellbore to be lined. The expandable portion may then be expanded into sealing engagement with the wellbore.

In another embodiment, the casing or liner string having at least one expandable portion may be used to restrict an inner diameter of a wellbore. Sometimes, it may be desirable to restrict the inner diameter such that the flow velocity may be increased. For example, in a gas well, an increase in flow may keep the head of the water from killing the well. In such instances, the string may be positioned inside the wellbore and thereafter expanded into sealing engagement with the wellbore. In this manner, the expanded string may restrict the inner diameter of the wellbore.

In another embodiment, the casing or liner string having at least one expandable portion may be used to insulate a wellbore. For example, insulation may be desired to keep the production near the reservoir temperature, thereby reducing the tendency of the gas to form condensate that may kill the well. In such instances, the string may be positioned inside the wellbore and thereafter expanded into sealing engagement with the wellbore. The additional layer of tubular may provide insulation to the well.

In another embodiment, a method for creating and testing an annular barrier in a wellbore includes positioning a tubular having an expandable portion in the wellbore, the expandable portion having a non-circular cross-section; applying a first pressure to expand the expandable portion into sealing engagement with the wellbore; supplying cement through a selectively actuatable fluid circulation tool; applying a second pressure to a first side of the sealing engagement between expandable portion and the wellbore; and monitoring a second side of the sealing engagement for a change in pressure.

Various components or portions of the embodiments disclosed herein may be combined and/or interchanged to tailor the casing or liner string for the requisite application. For example, the various selectively actuatable fluid circulation tools such as the port collar and the stage tool may be interchanged. Additionally, seating tools such as a ball seat may be replaced with another seating tool adapted to receive another released device such as a dart.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of the invention and are therefore not to be considered limiting of its scope, for the invention may admit to other equally effective embodiments.

FIG. 5 shows another embodiment of an expandable barrier. As shown, the expandable barrier includes an unexpanded folded expandable portion and a cross-section thereof and having two elastomeric coated regions about a perimeter of the folded portion.

FIGS. 6-7 show the expandable barrier of FIG. 5 in sequential activation.

FIG. 8 is a partial view of another embodiment of an expandable barrier. As shown, the expandable barrier includes a drill shoe having a ball seat.

FIG. 9 shows another embodiment of an expandable barrier. As shown, the expandable barrier is provided with a port collar.

FIGS. 10-18 show the expandable barrier of FIG. 9 in sequential operation. FIGS. 12-17 further show an inner string having a port collar operating tool and a stinger.

DETAILED DESCRIPTION OF THE PREFERRED EMBODIMENT

The invention generally relates to methods and apparatus for creating an annular barrier about a casing shoe.

Expandable Barrier

Figure 1:
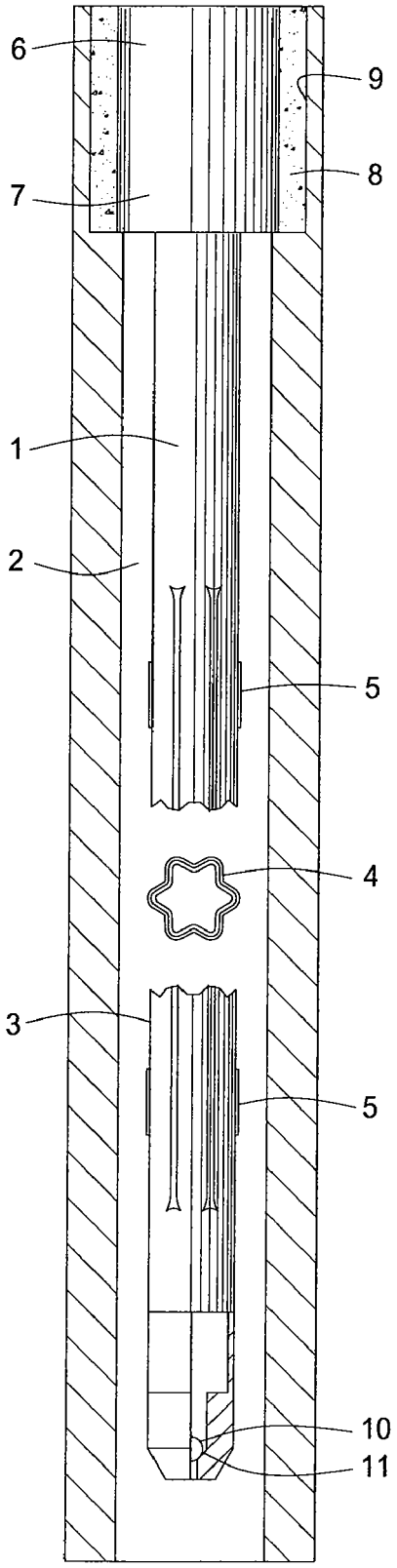
FIG. 1 shows a casing string in a sectioned wellbore where the casing string includes an unexpanded folded expandable portion and a cross-section thereof and having two elastomeric coated regions about a perimeter of the folded portion.
Figure 2:
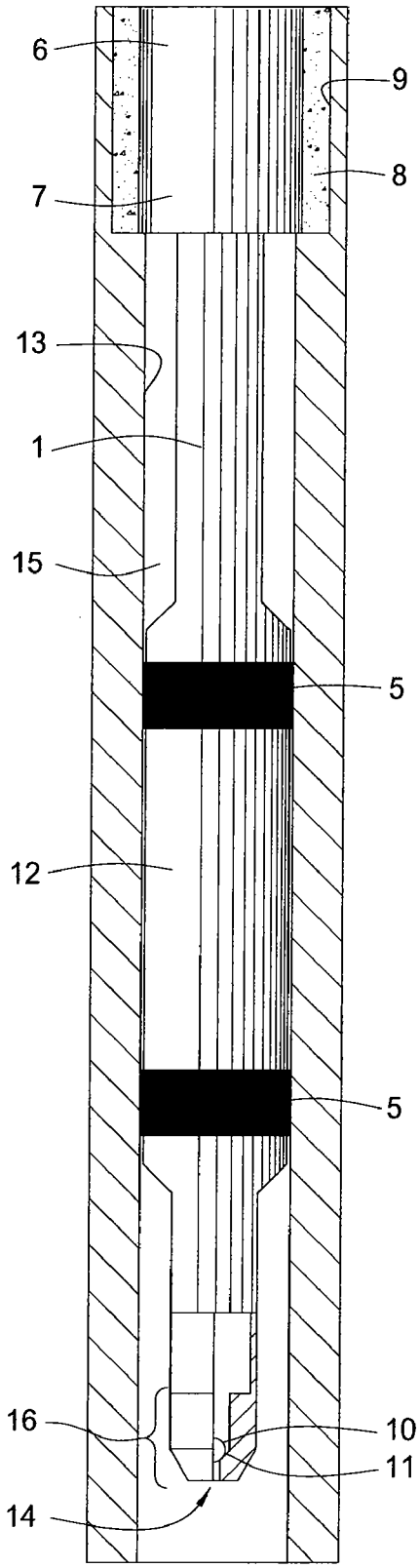
FIG. 2 shows a casing string in a sectioned wellbore where the casing string includes an expanded expandable portion having two elastomeric coating regions in contact with the wellbore.
Figure 3:
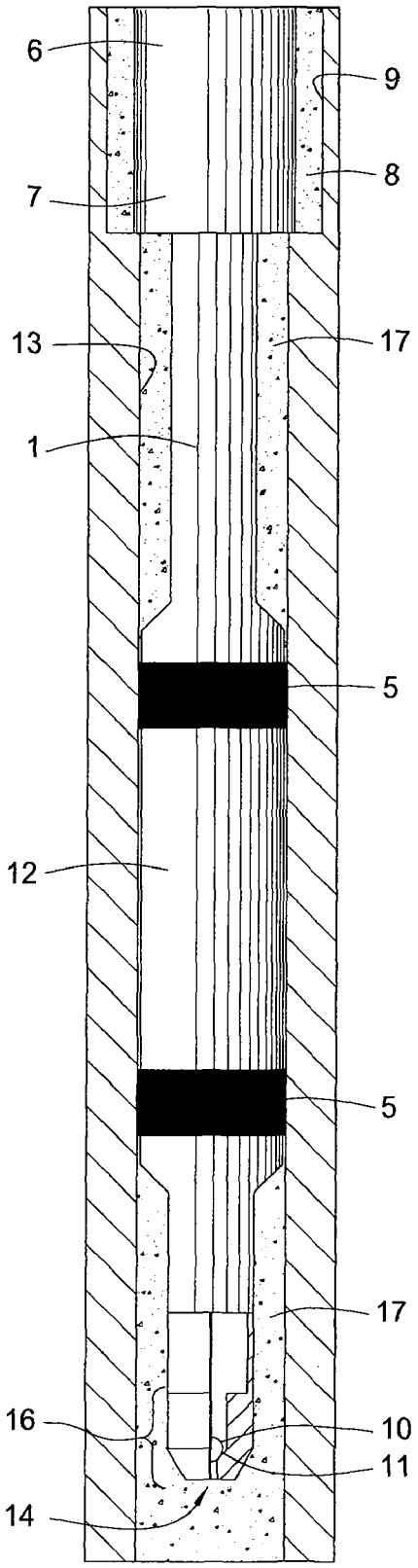
FIG. 3 shows a casing string in a sectioned wellbore where the casing string includes an expanded expandable portion having two elastomeric coating regions in contact with cement and the wellbore.

The embodiments of FIGS. 1, 2 and 3 are shown deployed beneath a previously and conventionally installed casing 6 in a previously drilled wellbore 9. The annular barrier between the conventional shoe portion 7 of the previously installed casing 6 and the previously drilled wellbore 9 is only cement 8.

FIG. 1 shows a casing string 1 deployed in a sectioned wellbore 2 where the casing string 1 includes an unexpanded folded expandable portion 3 and a cross-section thereof 4 and having two elastomeric coated regions 5 about a perimeter of the folded portion 3. The wellbore 2 is drilled after testing of the barrier formed by the cement 8. The casing string 1 is lowered from the surface into the wellbore 2. A ball 10 is placed in the interior of the casing 1 and allowed to seat in a ball seat 11, thereby plugging the lower end of the casing string 1.

A predetermined pressure is applied to the interior of the casing 1 thereby unfolding the expandable portion 3. As shown in FIG. 2, the unexpanded folded expandable portion 3 becomes an expanded portion and an annular barrier 12 in response to the predetermined pressure. During expansion, the unexpanded portion 3 pushes radially outward toward a wellbore wall 13 and correspondingly presses the elastomeric coated regions 5 into sealing engagement with the wellbore wall 13. Optionally, the coated regions 5 may comprise any suitable compressible coating such as soft metal, Teflon, elastomer, or combinations thereof. Alternatively, the expanded portion 12 may be used without the coated regions 5. The ball 10 is now removed from the ball seat 11 so that fluid path 14 is unobstructed. Pressure is applied to the interior of the casing string 1, and wellbore annulus 15 is monitored for pressure change. If no pressure change is observed in the wellbore annulus 15, then the annular barrier 12 has been successfully deployed. Upon determination of such successful deployment, the shoe portion 16 is drilled through and drilling of a subsequent stage of the well may progress.

FIG. 3 shows a deployed annular barrier 12 surrounded by cement 17. In the embodiment of FIG. 3, deployment of the annular barrier 12 progresses as described above in reference to FIGS. 1 and 2 with a couple of notable exceptions. Before seating of the ball 10 in the ball seat 11 and before the application of the predetermined pressure (for expanding the unexpanded folded expandable portion), a volume of cement slurry is pumped as a slug down through the interior of the casing 1, out through the fluid path 14, and up into the wellbore annulus 15. The cement slurry slug may be preceded and/or followed by wiper plugs (not shown) having suitable internal diameters (for passing the ball 10) initially obstructed by properly calibrated rupture disks. The ball 10 is then located in the ball seat 11, and the predetermined expanding pressure is applied to the interior of the casing 1. The ball 10 is now removed from the ball seat 11 so that fluid path 14 is unobstructed. Pressure is applied to the interior of the casing string 1 and the wellbore annulus 15 is monitored for pressure change. If no pressure change is observed in the wellbore annulus 15 then the annular barrier 12 has been successfully deployed. If a pressure increase is observed in the wellbore annulus 15, then the cement is given a proper time to cure and the pressure is reapplied to the interior of the casing 1. Upon determination that there is no corresponding pressure change in the wellbore annulus 15, the shoe portion 16 is drilled through and drilling of a subsequent stage of the well may progress.

Figure 4:
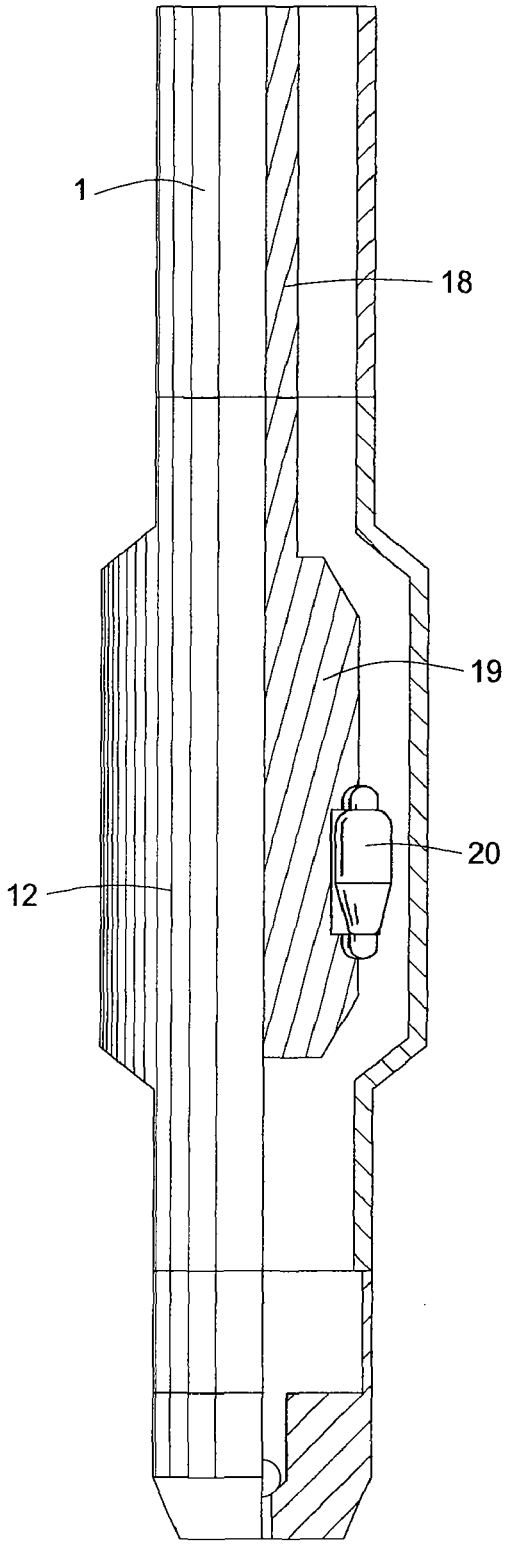
FIG. 4 shows a casing string in half section including an expanded expandable portion having a rotary expansion tool disposed therein.

FIG. 4 shows a rotary expansion tool 19 suspended on a work string 18 and having at least one radially extendable expansion member 20. The work string 18 with the rotary expansion tool 19 connected thereto are lowered through the casing 1 until the expansion member 20 is adjacent an expanded portion 12 of the casing string 1. The embodiment shown in FIG. 4 may be optionally used in the processes described above regarding FIGS. 1, 2 and 3.

Referring to FIGS. 2 and 3, a predetermined pressure is applied to the interior of the casing 1 thereby unfolding the expandable portion 3. As shown in FIG. 2 the unexpanded folded expandable portion 3 becomes an expanded portion and an annular barrier 12 in response to the predetermined pressure. The expanded portion 12 thereby pushes radially outward toward a wellbore wall 13 and correspondingly presses the elastomeric coated regions 5 into sealing engagement with the wellbore wall 13. Optionally, the coated regions 5 may comprise any suitable compressible coating such as soft metal, Teflon, elastomer, or combinations thereof. Alternatively, the expanded portion 12 may be used without the coated regions 5. The ball 10 is now removed from the ball seat 11 so that fluid path 14 is unobstructed. Pressure is applied to the interior of the casing string 1 and wellbore annulus 15 is monitored for pressure change. If no pressure change is observed in the wellbore annulus 15 then the annular barrier 12 has been successfully deployed. If a pressure increase is observed in the wellbore annulus 15, then referring to FIG. 4, the rotary expansion tool 19 is lowered on the work string 18 through the casing 1 until the expansion member 20 is adjacent an interior of the expanded portion 12. An expansion tool activation pressure is applied to the interior of the work string 18 thereby radially extending the at least one expansion member 20 into compressive contact with the interior of the expanded portion 12. The work string 18 is simultaneously rotated and axially translated along at least a portion of the interior of the expanded portion 12 thereby further expanding the portion of the expanded portion into more intimate contact with the wellbore wall 13. Following the rotary expansion of the expanded portion 12, the work string 18 and expansion tool 19 are withdrawn from the well. Pressure is now reapplied to the interior of casing 1 and pressure is monitored in annulus 15. If no pressure change is observed in annulus 15, then the shoe portion 16 is drilled through and drilling of a subsequent stage of the well may progress. Optionally, the previously described step of placing cement in annulus 15 may be used in combination with the step of pressurized unfolding and the step of rotary expansion as described herein.

Expandable Barrier with Extrudable Ball Seat

FIG. 5 shows another embodiment of an expandable fluid barrier 100. The expandable barrier 100 is disposed in a section of a wellbore 102 formed below a cased portion of the previously formed wellbore 9. The expandable barrier 100 includes a casing string 101 having an unexpanded folded expandable portion 103 and two seal regions 105 disposed about a perimeter of the expandable portion 103. In one embodiment, the expandable portion 103 is corrugated or crinkled to form grooves within the casing string 101, as illustrated by the cross-sectional view 104. However, the cross-section may take on other folded shapes suitable for expansion, such as symmetrical or asymmetrical grooves. Exemplary expandable portions 103 suitable for use with the embodiments disclosed herein are shown in U.S. Pat. No. 6,708,767, U.S. Patent Application Publication No. 2004/0159446, and U.S. Patent Application Publication No. 2005/0045342, which patent and applications are assigned to the same assignee of the present application and are herein incorporated by reference in their entirety. The seal regions 105 may comprise Teflon, soft metal, compressible materials, elastomeric materials such as rubber, swellable rubber, and thermoset plastics, or combinations thereof. Additional seal regions 105 may be provided to increase the sealing effect.

An extrudable ball seat 130 is provided at a lower end of the casing string 101. The ball seat 130 is adapted to receive a ball, thereby closing off fluid communication through the lower portion of the casing string 101. The ball seat 130 retains the ball in the ball seat 130 until a predetermined pressure is reached. The ball is extruded through the ball seat 130 when the predetermined pressure is obtained or exceeded, thereby reestablishing fluid communication. The pressure at which the ball is extruded should be higher than the pressure at which the expandable portion 103 unfolds. In this respect, pressure may be built up in the casing string 101 to unfold the expandable portion 103 before the ball is extruded. This higher ball extrusion pressure also prevents the over expansion of the expandable portion 103. An exemplary extrudable ball seat is disclosed in U.S. Patent Application Publication No. 2004/0245020, which patent is herein incorporated by reference in its entirety.

In operation, the expandable barrier 100 is lowered into the wellbore 102 for deployment. After placement in the wellbore 102, a ball 110 is placed in the interior of the casing string 103 and allowed to seat in the ball seat 130, thereby closing off fluid communication through the ball seat 130 and the lower portion of the casing string 101, as illustrated in FIG. 6. Fluid pressure is then applied to the interior of the casing string 101 to urge the unfolding of the expandable portion 103. In this respect, the internal pressure causes the expandable portion 103 to expand radially outward toward a wellbore wall 113 and correspondingly presses the elastomeric seal regions 105 into sealing engagement with the wellbore wall 113. FIG. 6 shows the expandable portion 103 expanded against the wellbore wall 113. Thereafter, additional fluid pressure is applied to extrude the ball 110 from the ball seat 130 from the casing string 101, as illustrated in FIG. 7. Once fluid communication through the casing string 101 is reestablished, a pressure test is performed by applying pressure to the interior of the casing string 101 and monitoring the annulus 115 for pressure change. If no pressure change is observed, the expandable barrier 100 has been successfully deployed to seal off the annulus 115. However, if a pressure change in the annulus 115 is observed, a recovery operation is performed using a mechanical expansion tool to further expanding the expandable portion 103 as previously described.

In another embodiment, an earth removal member may be coupled to a lower portion of the expandable barrier 100. Suitable earth removal members include a drill bit, reamer shoe, and expandable drill bit. Such earth removal members may be constructed of a material that is drillable by a subsequent earth removal member. Suitable drillable materials include aluminum, copper, brass, nickel, thermoplastics, and combinations thereof. Exemplary earth removal members suitable for use with the various embodiments disclose herein are shown in U.S. Patent Application Publication No. 2002/0189863, which application is assigned to the same assignee as the present application and is incorporated herein by reference in its entirety. In FIG. 8, a drill bit 135 is shown with cutting members 137 disposed on the exterior and ports 138 for fluid communication through the drill bit 135. The drill bit 135 may also include an extrudable ball seat 130 for receiving a ball. It is also contemplated that the drill bit 135 and the ball seat 130 may be separately connected to the casing string 101.

In operation, the expandable barrier 100 is lowered into the previously cased wellbore 9. The drill bit 135 is activated to form the next section of wellbore 102. After drilling, the expandable barrier 100 may be operated in a manner disclosed with respect to FIGS. 6-7. In this respect, a ball 110 is placed into the interior of the casing string 101 and allowed to seat in the ball seat 130, thereby closing off fluid communication through the ball seat 130 and the lower portion of the casing string 101, as illustrated in FIG. 6. Fluid pressure is then applied to the interior of the casing string 101 to urge the unfolding of the expandable portion 103. In this respect, the expandable portion 103 expands radially outward toward a wellbore wall 113 and correspondingly presses the elastomeric seal regions 105 into sealing engagement with the wellbore wall 113. FIG. 6 shows the expandable portion 103 expanded against the wellbore wall 113. Thereafter, additional fluid pressure is applied to extrude the ball 110 from the ball seat 130, as illustrated in FIG. 7. Once fluid communication through the casing string 101 is reestablished, a pressure test is performed by applying pressure to the interior of the casing string 101 and monitoring the annulus 115 for pressure change. If no pressure change is observed, the expandable barrier 100 has been successfully deployed to seal off the annulus 115. In this manner, the wellbore 102 may be drilled and sealed in a single trip.

Expandable Barrier with Port Collar

In another embodiment, the expandable barrier 200 may include a selectively actuatable fluid circulation tool to facilitate cementing operations. Referring to FIG. 9, the expandable barrier 200 shown is substantially similar to the expandable barrier 100 of FIG. 5; thus, like parts are similarly numbered and will not be discussed in detail again. As shown, the selectively actuatable fluid circulation tool comprises a port collar 240 that is disposed above the unexpanded folded expandable portion 203. An extrudable ball seat 230 is disposed at the lower portion of the casing string 201. It must be noted that a drill shoe 235 may be provided so that the wellbore 202 may be drilled and sealed in a single trip, as described with respect to FIG. 8.

The port collar 240 includes a tubular housing 241 and a movable sleeve 242 disposed in the housing 241. The housing 241 is adapted for coupling with the casing string 201 and includes one or more ports 243 formed through the housing 241 such the fluid communication between the interior of the casing string 201 and the annulus 215 is possible. The sleeve 242 is disposed in a recess 244 of the housing 241 and the inner diameter of the sleeve 242 is substantially the same as the inner diameter of the casing string 201 so as to prevent obstruction of the bore of the casing string 201. The recess 244 is sufficiently sized to allow axial movement of the sleeve 242 in the recess 244 such that movement of the sleeve 242 from one position to another will close or open the ports 243 in the housing 241. Latch profiles 245 are formed on the interior of the sleeve 242 for controlled movement of the sleeve 242 between the open and close positions. Two o-rings 246 or other suitable sealing elements are disposed on the sleeve 242 and positioned on either side of the ports 243 to prevent leakage of fluid.

To seal the annulus 215, a ball 210 is placed into the interior of the casing string 201 and allowed to seat in the ball seat 230, thereby closing off fluid communication through the lower portion of the casing string 201, as illustrated in FIG. 10. Fluid pressure is then applied to the interior of the casing string 101 to unfold the expandable portion 203 and urge the seal regions 205 into sealing engagement with the wellbore wall 213. Thereafter, additional fluid pressure is applied to extrude the ball 210 from the ball seat 230. Once fluid communication through the casing string 201 is reestablished, a pressure test is performed by applying pressure to the interior of the casing string 201 and monitoring the annulus 215 for pressure change. If no pressure change is observed in the annulus 215, then expandable barrier 200 has been successfully deployed.

Figure 11:
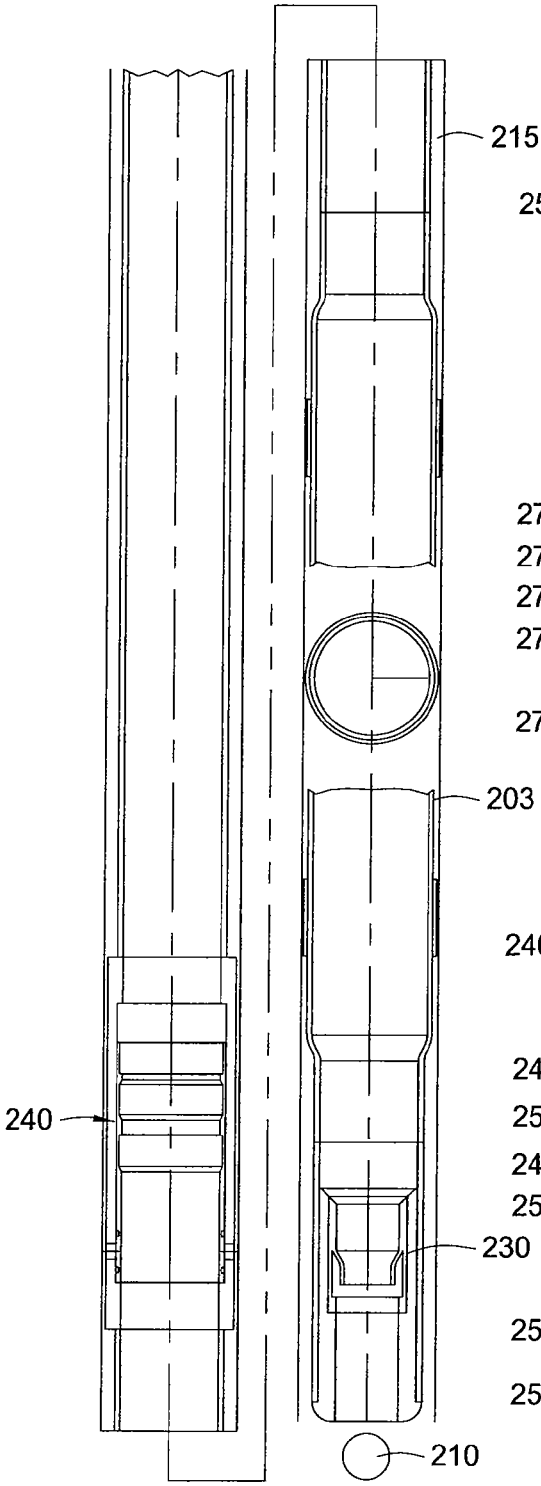

In FIG. 11, the expandable portion 203 was not fully expanded due to the premature extrusion of the ball 210. Because the annulus 215 was not properly sealed, a satisfactory pressure test was not obtained.

Figure 12:
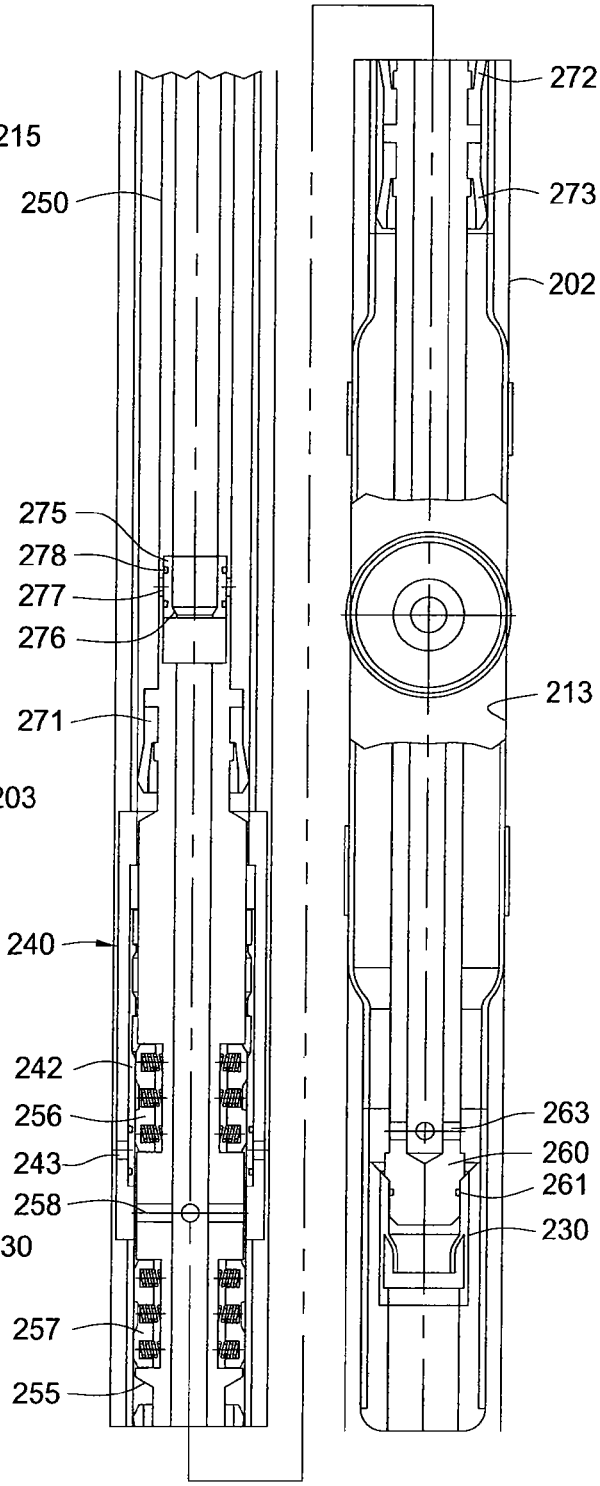

In the event that a pressure increase is observed, another expansion process or a cementing operation may be performed as a recovery operation to seal off the annulus 215. Referring to FIG. 12, an inner string 250 having a port collar operating tool 255 and a stinger 260 is lowered into the casing string 201. The stinger 260 is adapted to sealingly mate with an upper portion of the ball seat 230. One or more o-rings 261 may be provided to ensure the stinger 260 is fluidly sealed against the ball seat 230. Positioned above the stinger 260 are one or more ports 263 for fluid communication between the interior of the inner string 250 and the interior of the casing string 201.

The port collar operating tool 255 is adapted to engage the sleeve 242 of the port collar 240. The port collar operating tool 255 includes two sets of spring biased dog latches 256, 257 for mating with the latch profiles 245 of the sleeve 242. One set of latches 256 has mating profiles 245 that is adapted to move the sleeve 242 to the open position, and the other set of latches 257 has mating profiles that is adapted to move the sleeve 242 to the closed position. The operating tool 255 also has one or more ports 258 for fluid communication with the port 243 of the port collar 240 when the sleeve 242 is in the open position.

The inner string 250 also includes a plurality of cup seals 271, 272, 273 disposed on its exterior. The first cup seal 271 is positioned above the operating tool 255 and is adapted to allow fluid flow in a direction away from the surface. The second cup seal 272 is positioned below the operating tool 255 and is adapted to allow fluid flow in a direction toward the surface. The third cup seal 273 is positioned below the second cup seal 272 and is adapted to allow fluid flow in a direction away from the surface.

A circulation valve 275 is provided on the inner string 250 and positioned above the first cup seal 271. The circulation valve 275 has a ball seat 276 that is positioned to close the circulation port 277. The ball seat 276 is selectively movable relative to the port 277 to open or close the port 277. Sealing elements 278 may be provided on the ball seat 276 to ensure closure of the circulation port 277.

Figure 13:
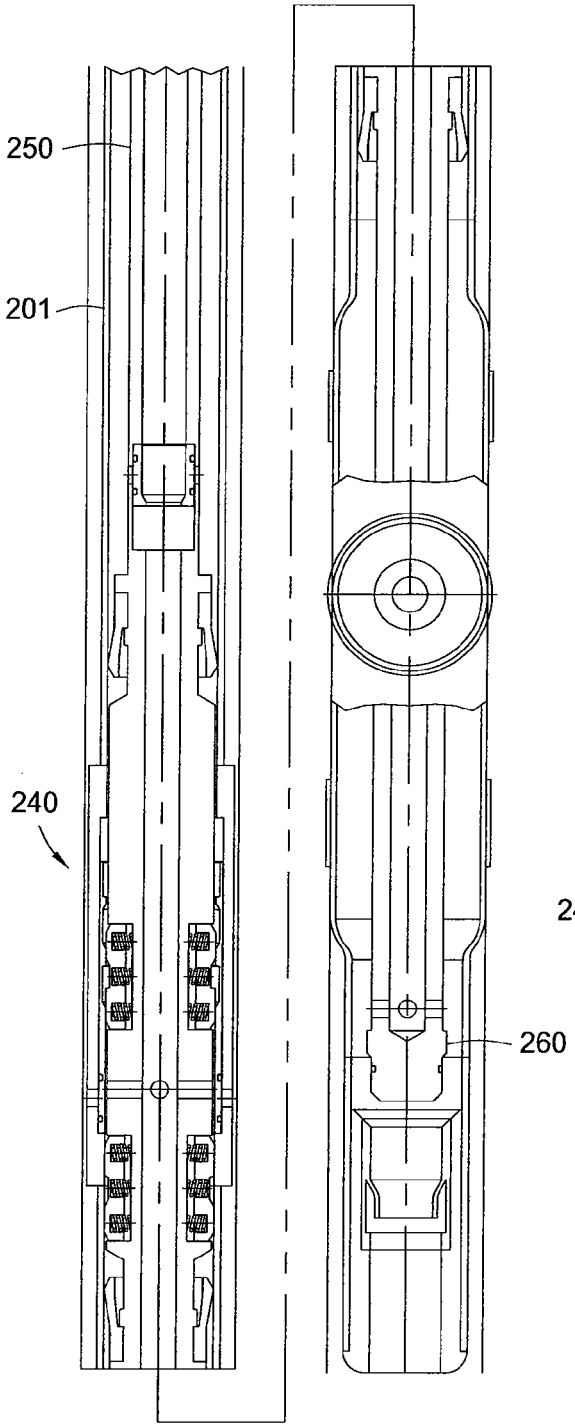

After the failure of the pressure test, the inner string 250, port collar operating tool 255, and the stinger 260 are lowered into the casing string 201 until the stinger 260 engages the extrudable ball seat 230, as shown in FIG. 12. The engagement of the stinger 260 to the ball seat 230 closes fluid communication through the ball seat 230 and the casing string 201. Fluid pressure is supplied through the inner string 250 and exit ports 263 to further expand the expandable portion 203. It can be seen in FIG. 12 that the expandable portion 203 has fully expanded against the wall 213 of the wellbore 202. After expansion, the inner string 250 is lifted to disengage the stinger 260 from the ball seat 230, thereby reestablishing fluid communication through the ball seat 230, as shown in FIG. 13. A second pressure test is conducted by applying pressure to the interior of the casing string 201 and monitoring the pressure in the annulus 215. If no pressure change is observed, the inner string 250 and the attached components are pulled out of the wellbore 202 and the next section of wellbore may be formed by drilling through the ball seat 230.

Figure 14:
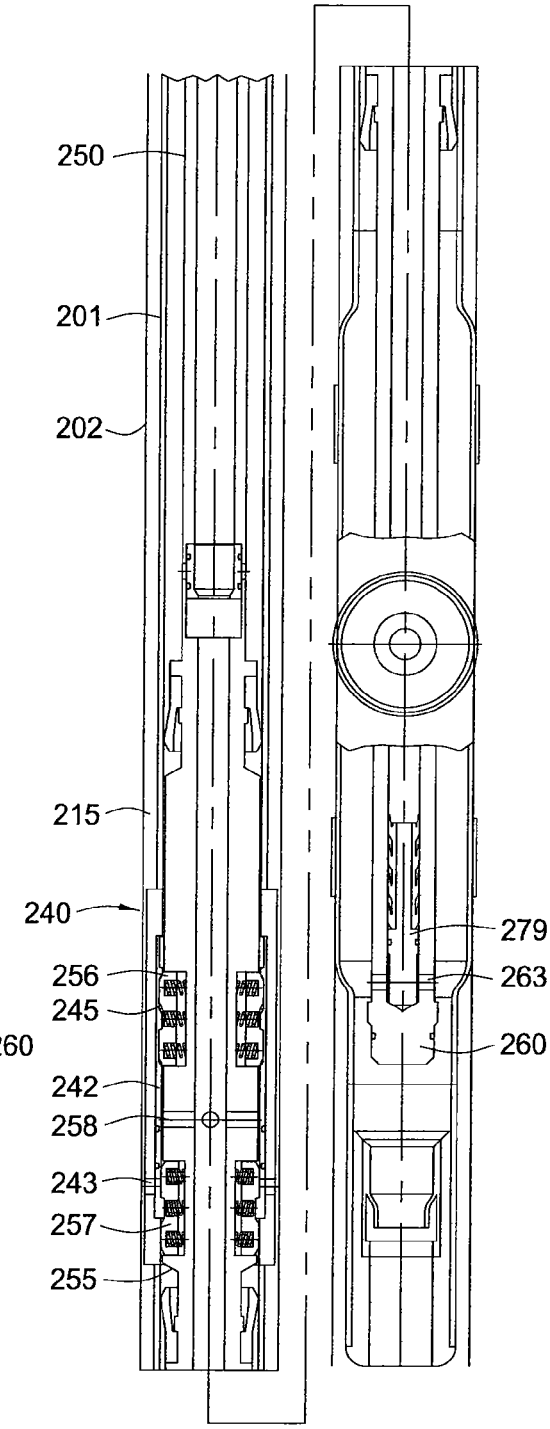

If a pressure leak is observed again, a cementing operation may be conducted to seal off the annulus 215. As shown in FIG. 14, a dart 279 is pumped down the inner string 250 to close off the ports 263 above the stinger 260. Thereafter, the ports 243 of the port collar 240 are opened. To open the port 243, the port collar operating tool 255 is moved so as to position the first set of latches 256 adjacent the latch profile 245 of the sleeve 242, whereby the spring biases the latches 256 into engagement with the latch profile 245. Then, the operating tool 255 is lifted to slide the sleeve 242 away from the port 243, thereby opening the port 243 for fluid communication with the inner string 250 through ports 258. Cement is supplied through the inner string 250 to fill the annulus 215 between the casing string 201 and the wellbore 202. The first cup seal 271 and the second cup seal 272 ensures that most of the cement is forced into the annulus 215 instead of the casing string 201.

Figure 15:
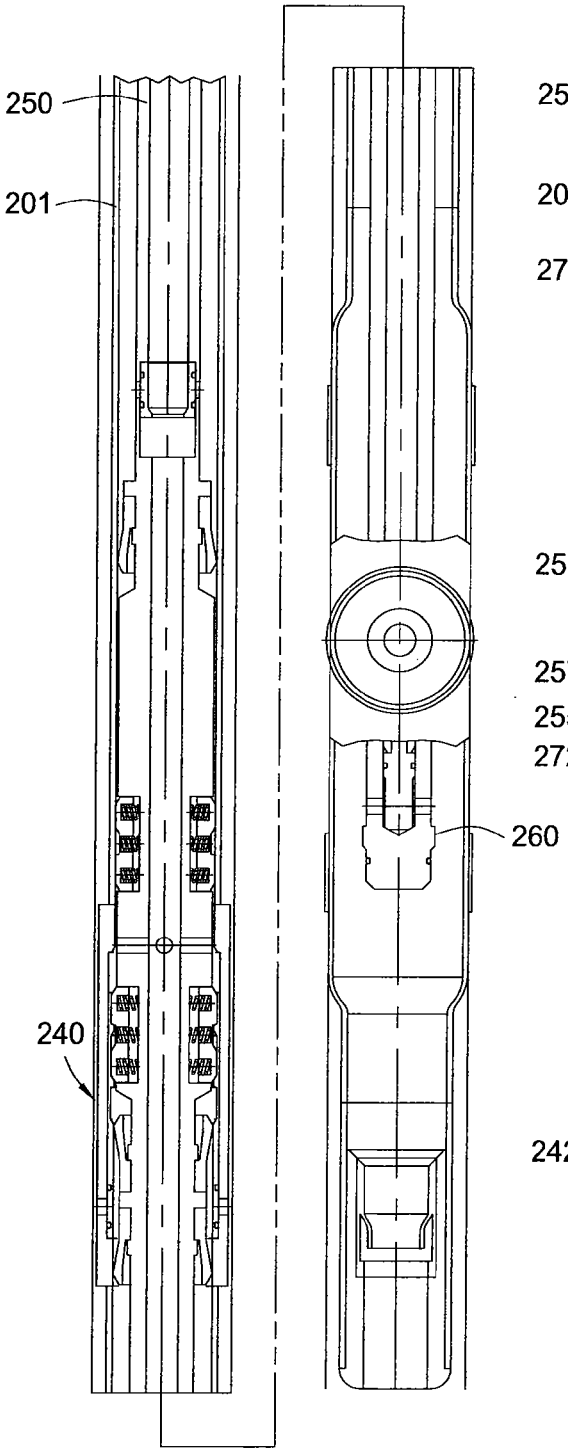

The port collar 240 is closed after cementing. Referring to FIG. 15, the operating tool 255 is lifted further to disengage the latches 256 from the latch profile 245 and to engage the second set of latches 257 with the latch profile 245. The operating tool 255 is then lowered to move the sleeve 242 over the port 243, thereby closing the port collar 240.

Figure 16:
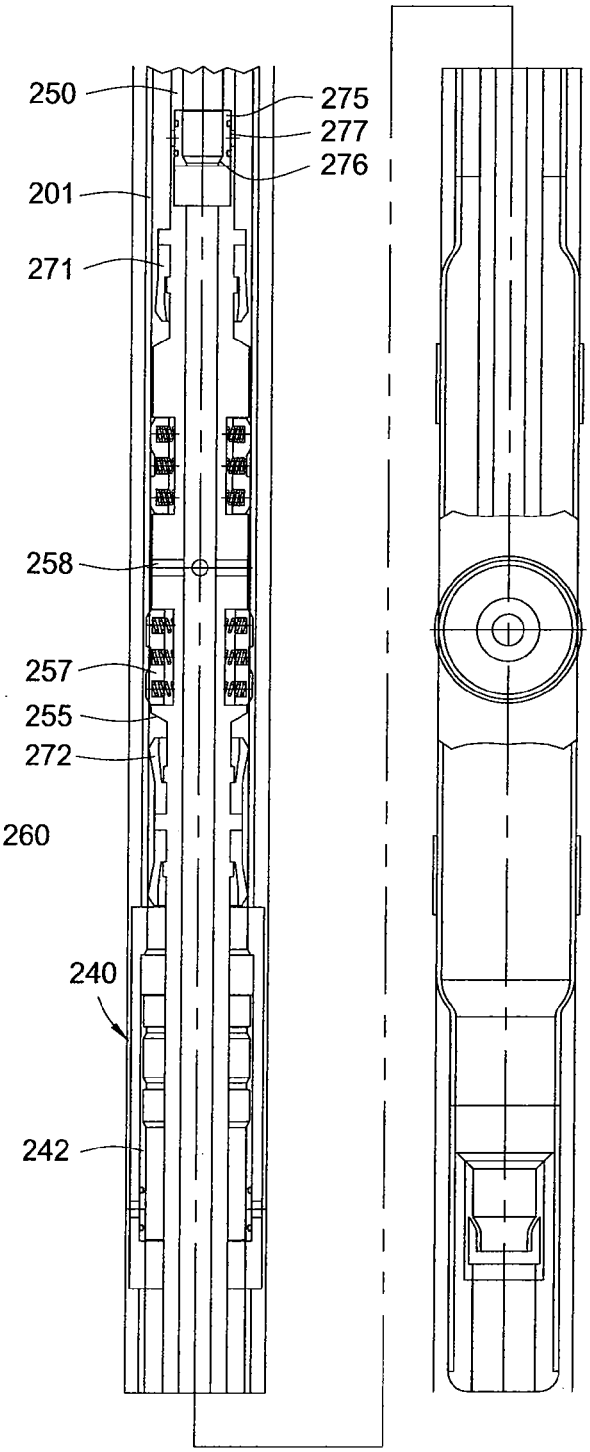

Excess cement in the hole is optionally removed by reverse circulation. In FIG. 16, the operating tool 255 has been lifted further to disengage the second set of latches 257 from the sleeve 242 and the operating tool 255 is positioned above the port collar 240. Circulation fluid is pumped down between the inner string 250 and the casing string 201, where it flows past the first cup seal 271, through the ports 258 of the operating tool 255, and up the inner string 250. The second cup seal 272 ensures that the circulating fluid and cement are routed back into the inner string 250.

Figure 17:
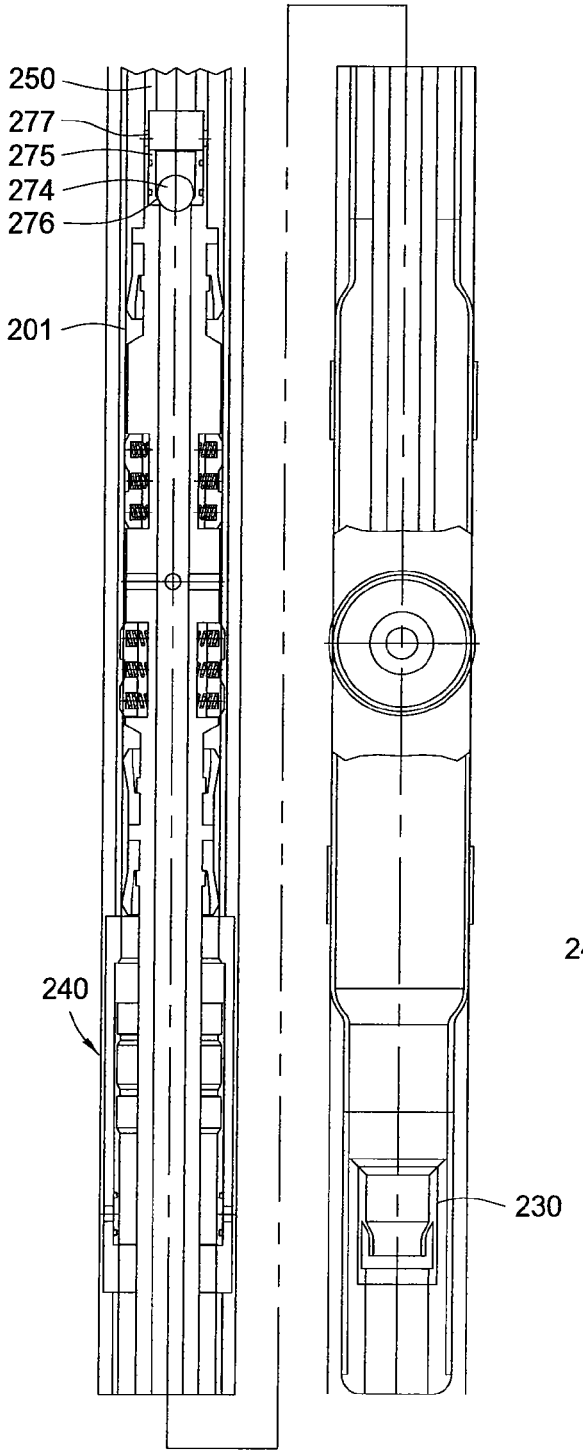
Figure 18:
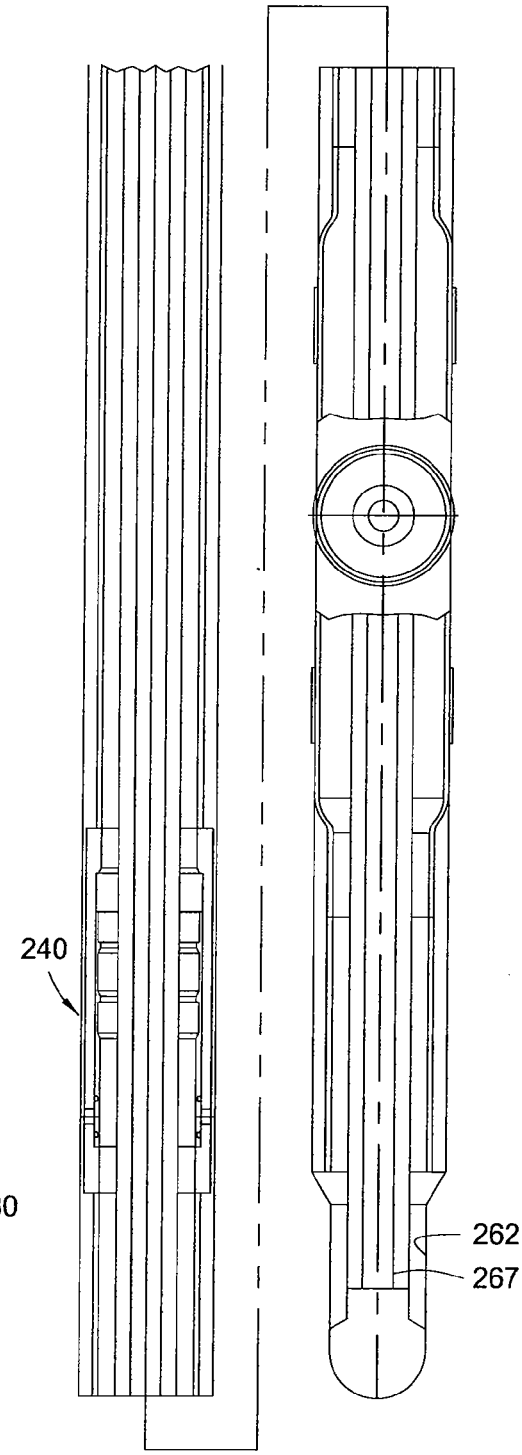

The circulation valve 275 is opened before the inner string 250 is pulled out of the hole. In FIG. 17, a ball 274 is placed into the inner string 250 to seat in the ball seat 276 of the valve 275, thereby closing off fluid communication through the inner string 250. Pressure is supplied above the valve 275 to cause the ball seat 276 to shift relative to the circulation port 277, thereby opening the circulation port 277. As the inner string 250 is pulled out of the hole, fluid is allowed to flow out of the inner string 250 through the circulation valve 275. In this manner, a "dry" inner string 250 may be removed from the hole. Thereafter, a drill string 266 is used to drill out the extrudable ball seat 230 and form the next the section of the wellbore 262, as shown in FIG. 18.

Expandable Barrier with Float Collar

Figure 19:
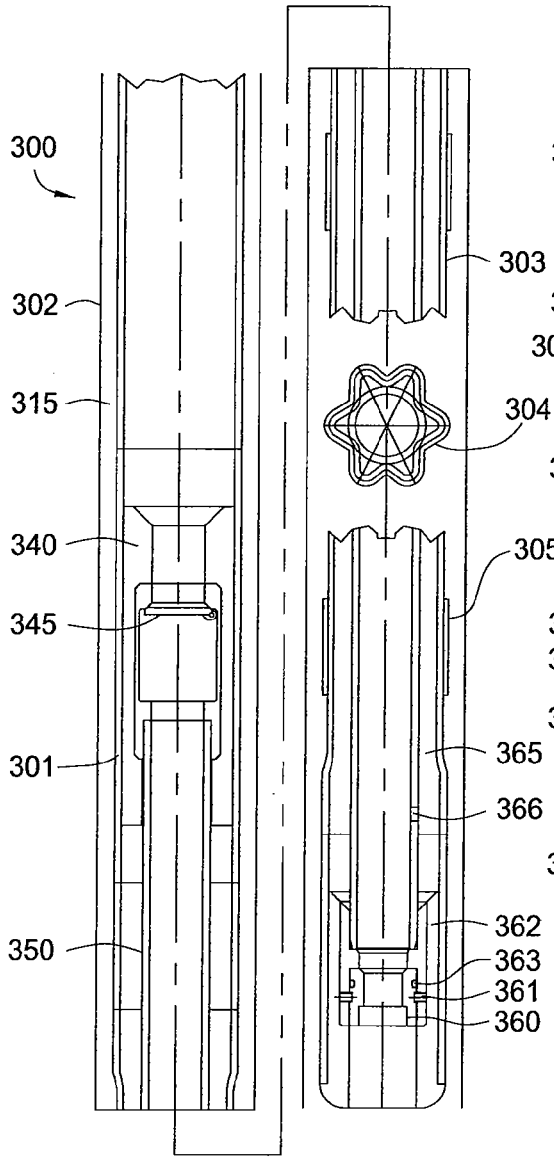
FIG. 19 shows another embodiment of an expandable barrier. As shown, the expandable barrier is provided with a flapper valve and a dart seat.
Figure 19A:
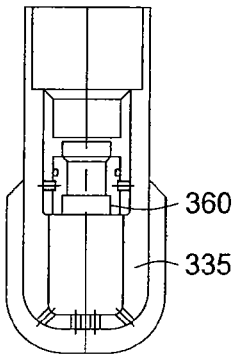

FIG. 19 shows another embodiment of an expandable barrier 300. The expandable barrier 300 is adapted for conducting the cementing operation prior to expansion of the expandable portion 303. The expandable barrier 300 is disposed in the wellbore 302 and includes parts that are similar to the expandable barrier 100 of FIG. 4 and will not be discussed in detail again. As shown, the expandable barrier 300 includes a float collar 340 having a flapper valve 345 disposed above the unexpanded folded expandable portion 303. An inner string 350 connects the float collar 340 to a removable dart seat 360 that is coupled to a shoe 362 disposed at the lower portion of the casing string 301. Preferably, the dart seat 360 is retained in the shoe 362 using one or more shearable members 361. Sealing elements such as o-rings 363 may be used to ensure a fluid tight seal between the dart seat 360 and the shoe 362. An annular area 365 is defined between the inner string 350 and the casing string 301 and extends from the float collar 340 to the shoe 362, including the length of the expandable portion 303. A cross-section of the annular area 365 is depicted as item 304. The annular area 365 is filled with a high viscosity fluid or an incompressible fluid such as grease prior to deployment. The inner string 350 includes a fluid port 366 for fluid communication with the annular area 365. Because of the fluid characteristics, the fluid will remain in the annular area 365 during operations. It must be noted that a drill shoe 335 may be coupled to or integrated with the dart seat 360 so that the wellbore 302 may be drilled and cased in a single trip, as shown in FIG. 19A. In another embodiment, the float collar may be equipped with other types of one way valves, such as a ball valve, bladder valve, or any other full opening valve that will let a dart through. It must be further noted that an extrudable ball seat may be used instead of the dart seat 360.

Figure 20:
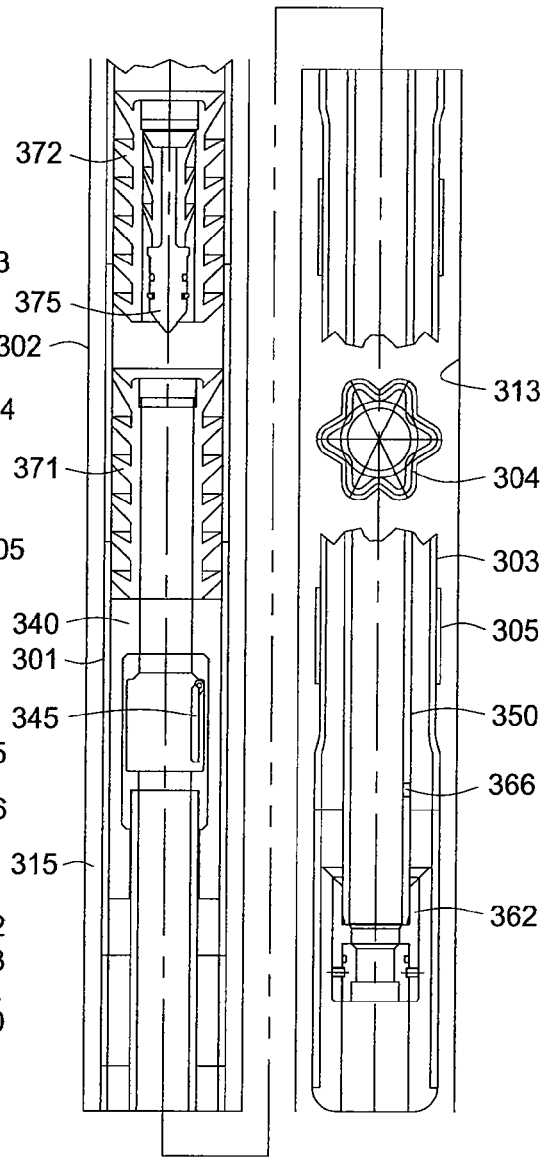
FIGS. 20-23 show the expandable barrier of FIG. 19 in sequential operation.

In this embodiment, a cementing operation may be conducted prior to expansion of the expandable portion 303. Referring to FIG. 20, cement is supplied through the flapper valve 345, the inner string 350, and the shoe 362 to fill the annulus 315 between the casing string 301 and the wellbore 302. The cement is separated from other wellbore fluids by a lower plug 371 and an upper plug 372 as it travels downhole. As shown, the lower plug 371 has landed on the float collar 340 and the upper plug 372 is closely behind. Thus, most of the cement has already been pumped into the annulus 315. It can also be seen that a dart 375 is positioned in the upper plug 372 and travels with the upper plug 372.

Figure 21:
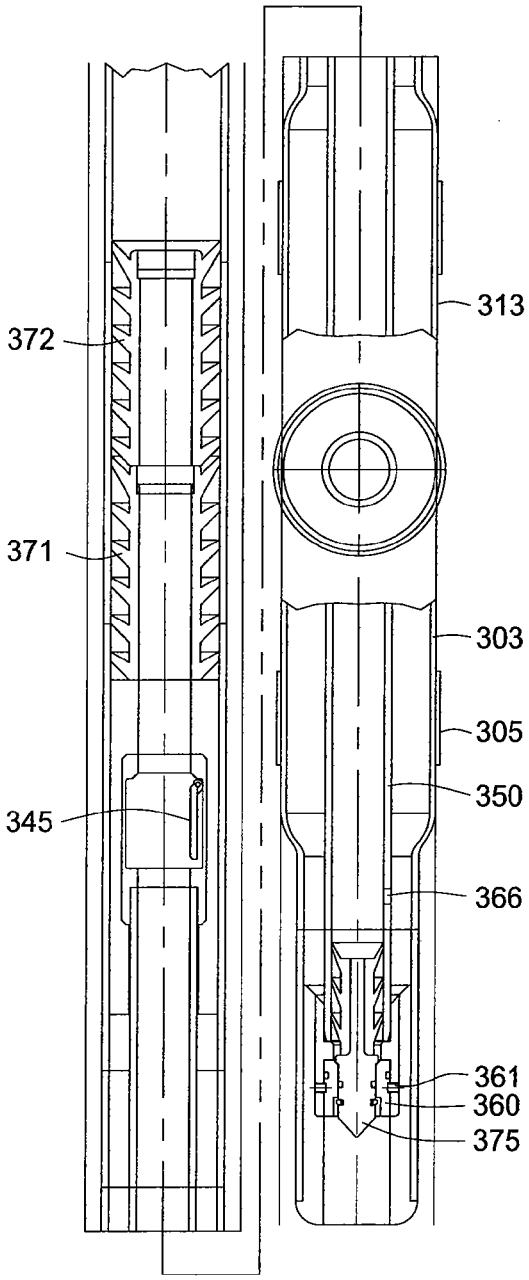

After the upper plug 372 lands on the lower plug 371, additional pressure is supplied to urge the dart 375 out of the upper plug 372 and seat in the dart seat 360, as shown in FIG. 21. In this respect, fluid communication through the dart seat 360 is closed. Alternatively, a ball may be used to close fluid communication instead of a dart 375. Pressure can now be supplied to expand the expandable portion 303. Fluid pressure is applied through the inner string port 366 into the annular area of the expandable portion 303. The expandable portion 303 pushes radially outward toward the wellbore wall 313 and correspondingly presses the seal regions 305 into the sealing engagement with the wellbore wall 313.

Figure 22:
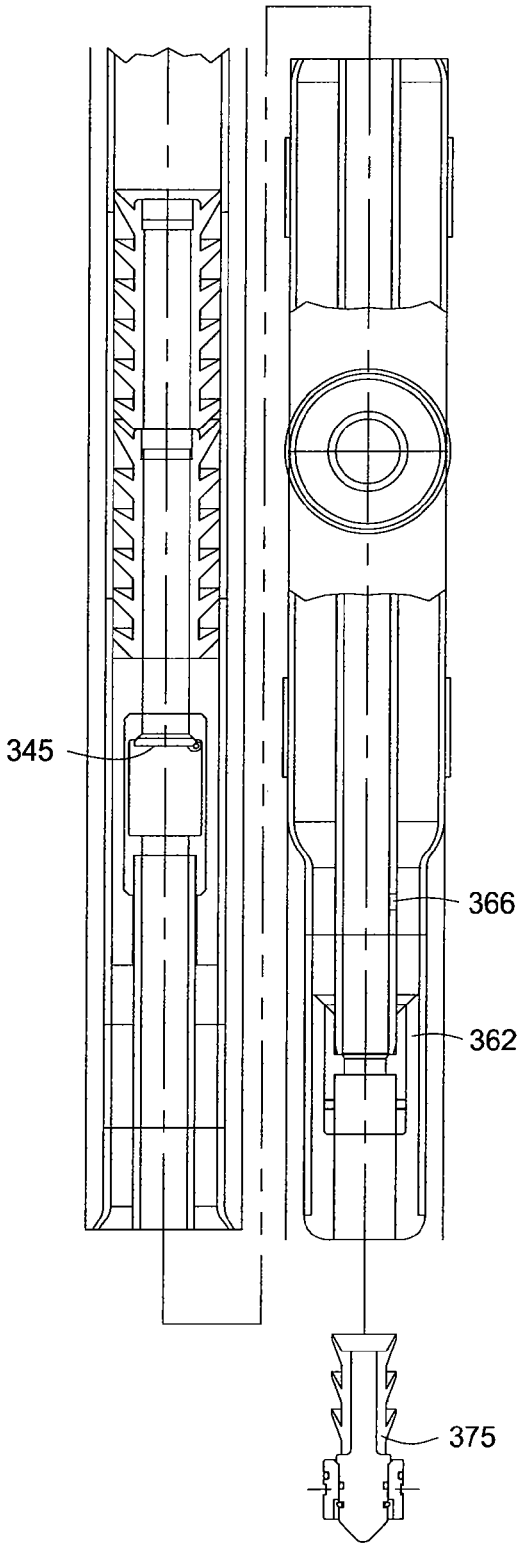
Figure 23:
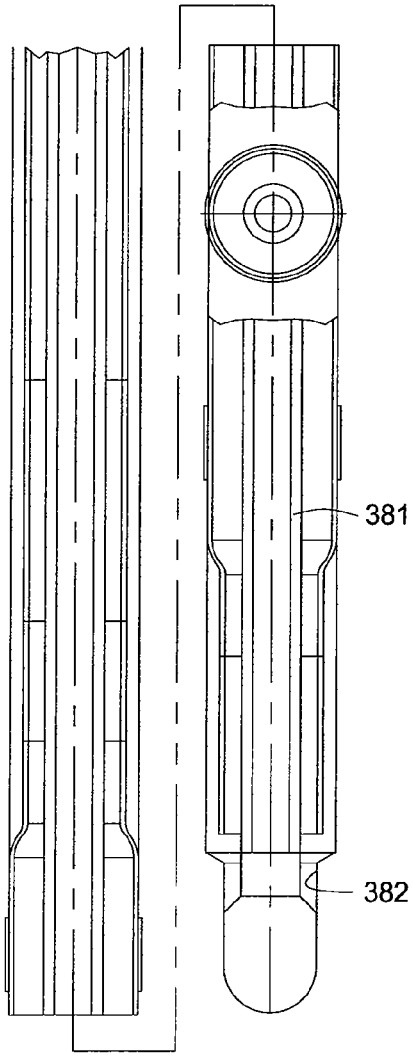

After expansion, pressure is supplied to shear the shearable member 361 and release the dart 375 and the dart seat 360. FIG. 22 shows the dart 375 pumped through the shoe 362 and the flapper valve 345 closed. The flapper valve 345 advantageously keeps the collapse pressure off of the expanded expandable portion 303 while the cement cures. After the cement cures, a drill string 381 is lowered into the casing string 301 to drill out the float collar 340, inner string 350, and the shoe 362 before forming the next section of wellbore 382, as illustrated in FIG. 23. It should be noted a second flapper valve, or other type of full opening valve, could be located in the shoe 362, if the operator desires a second float valve. However, the use a second float valve may negate the effect of keeping collapse pressure off the expanded metal packer.

Expandable Barrier with Stage Tool

Figure 24:
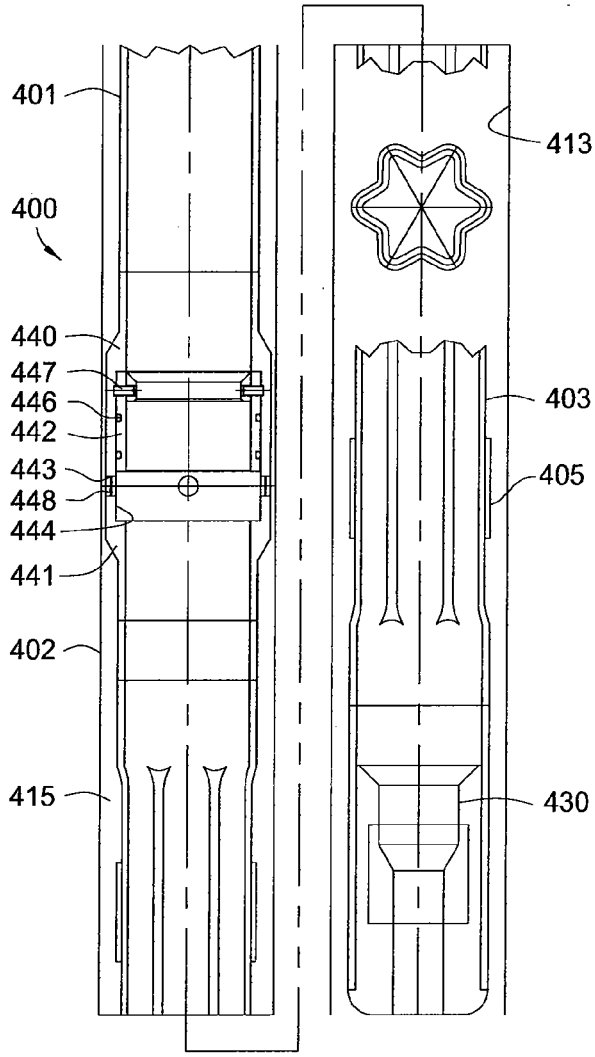
FIG. 24 shows another embodiment of an expandable barrier. As shown, the expandable barrier is provided with a stage tool.
Figure 24A:
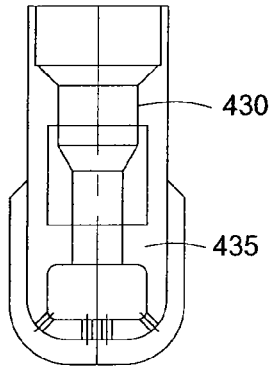
FIG. 24A is a partial view of another embodiment of an expandable barrier. As shown, the expandable barrier includes a drill shoe having a ball seat.

In another embodiment, the expandable barrier 400 may include a stage tool 440 to facilitate cementing operations. Referring to FIG. 24, the expandable barrier 400 shown is substantially similar to the expandable barrier 100 of FIG. 5; thus, like parts will not be discussed in detail again. As shown, the stage tool 440 is disposed above the unexpanded folded expandable portion 403. A ball seat 430 is disposed at the lower portion of the casing string 401. It must be noted that a drill shoe 435 may be coupled to or integrated with the ball seat 430 so that the wellbore 402 may be drilled and cased in a single trip, as shown in FIG. 24A.

The stage tool 440 includes a tubular housing 441 and one or more ports 443 initially closed by a rupture disk 448. A plug seat 442 is positioned above the ports 443 and releasably connected to the housing 441 using a shearable member 447. When released, the plug seat 442 is movable along a recess 444 such that movement of the plug seat 442 from the retained position to the released position close or open the ports 443 in the housing 441. Two o-rings 446 or other suitable sealing elements are disposed on the plug seat 442 to prevent leakage of fluid.

Figure 25:
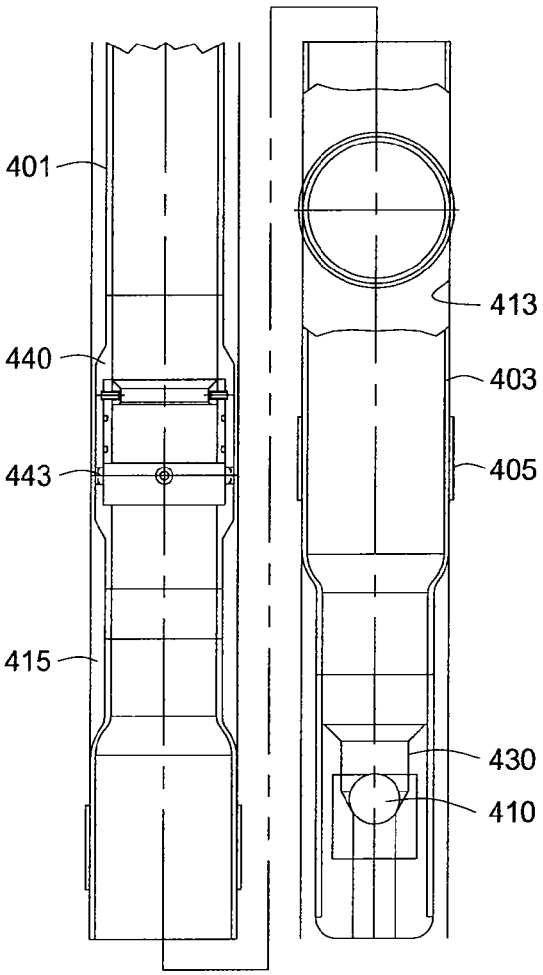
FIGS. 25-27 show the expandable barrier of FIG. 24 in sequential operation.
Figure 26:
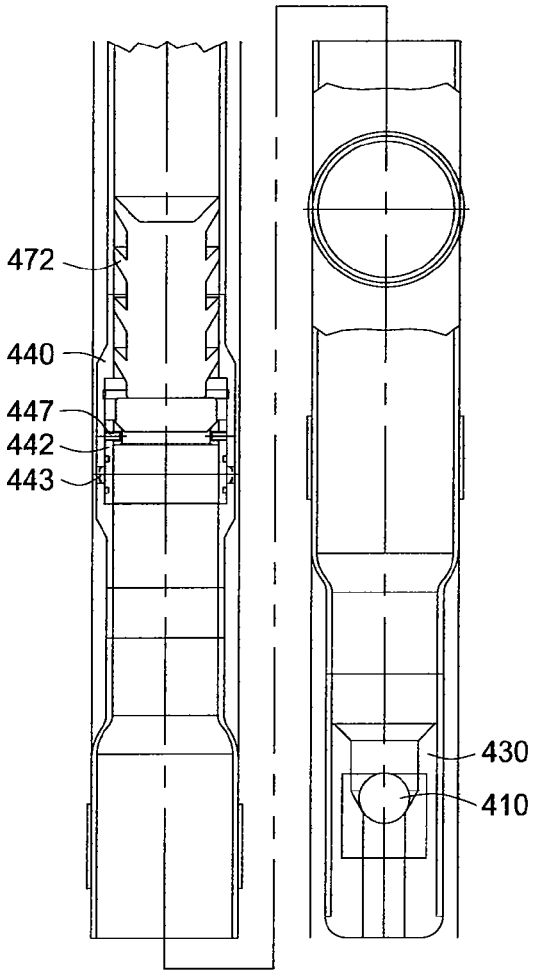
Figure 27:
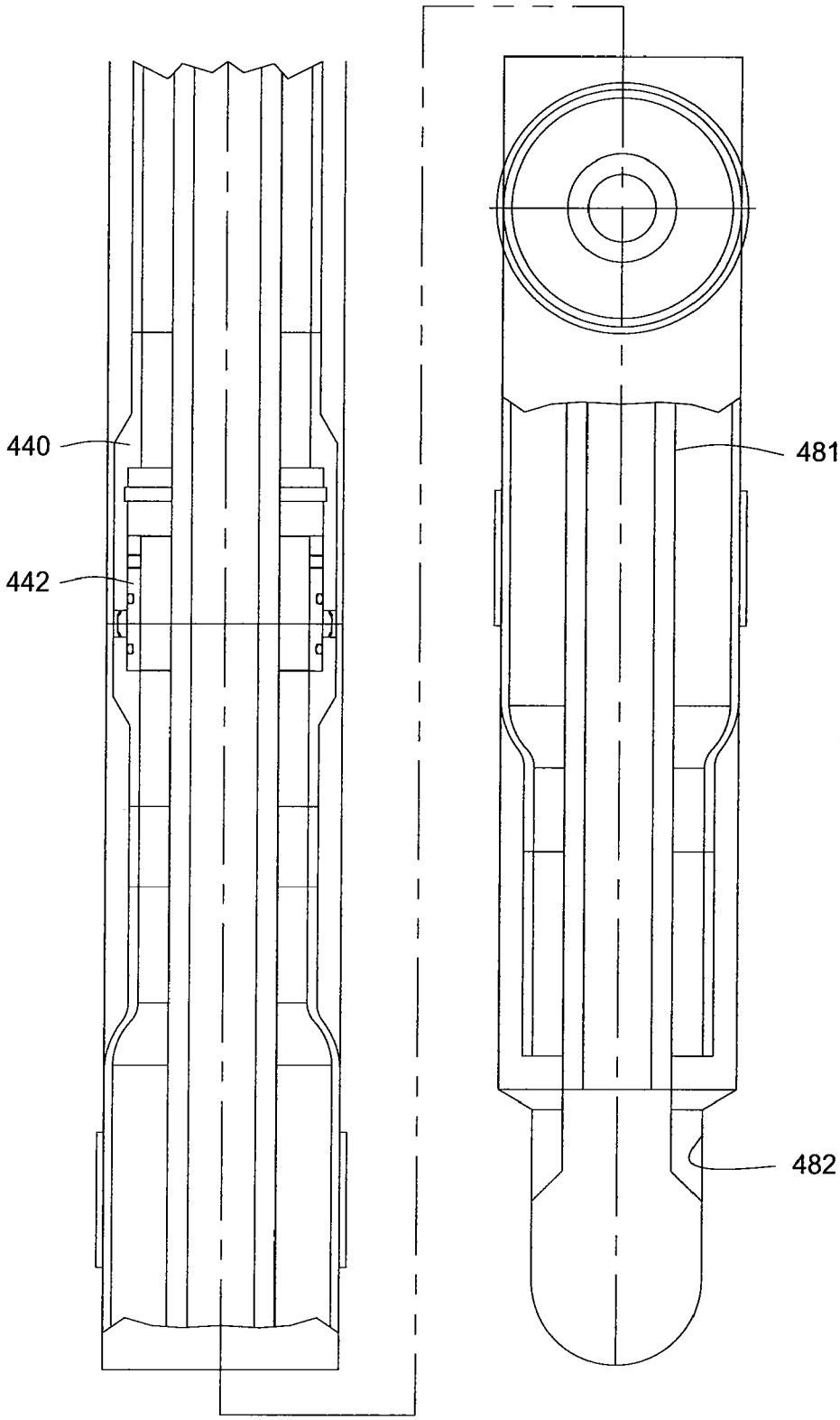

To seal the annulus 415, a ball 410 is placed into the interior of the casing string 401 and allowed to seat in the ball seat 430, thereby closing off fluid communication through the lower portion of the casing string 401, as illustrated in FIG. 25. Fluid pressure is then applied to the interior of the casing string 401 to unfold the expandable portion 403 and urge the seal regions 405 into sealing engagement with the wellbore wall 413. Thereafter, additional fluid pressure is applied to break the rupture disks 448 to establish fluid communication with the wellbore annulus 415. Then, cement is supplied through the casing string 401 and the port 443 in the stage tool 440. In FIG. 26, the closing plug 472 behind the cement has landed on the plug seat 442 and pressure behind the closing plug 472 breaks the shearable member 447, thereby releasing the plug seat 442. The plug seat 442 moves to the released position to close the port 443 of the stage tool 440. After the cement cures, a drill string 481 is lowered into the casing string 401 to drill out the stage tool 440 and the ball seat 430 before forming the next section of wellbore 482, as illustrated in FIG. 27.

Various components of the embodiments disclosed herein may be combined and/or interchanged as known to a person of ordinary skill in the art. For example, the ball seat 430 in the expandable barrier 400 of FIG. 24 may be replaced with an extrudable ball seat 230 shown in FIG. 9. In operation, pressure is supplied to extrude the ball 410 through the ball seat 230. Thereafter, a pressure leak test is conducted to determine the seal between the seal regions 405 and the wellbore 402. If the test is successful, further drilling may commence.

If a pressure leak is observed, additional steps are taken to further expand the expandable portion 403. In one embodiment, a dart having rupture disk is placed into the casing string 401 to seat in the extrudable ball seat 230. Thereafter, pressure is supplied to further expand the expandable portion 403. After expansion, pressure is increased to break the rupture disk of the dart in order to conduct a second pressure. If the seal is still unsatisfactory, a second dart is pump down to land behind the first dart to close fluid communication. Pressure is supplied to break the rupture disk 448 of the ports 443 of the stage tool 440. Cement is pumped down to fill the annulus 415. The closing plug 472 behind the cement lands on the plug seat 442 and breaks the shearable member 447, thereby releasing the plug seat 442. The plug seat 442 moves to the released position to close the port 443 of the stage tool 440. After the cement cures, a drill string 481 is lowered into the casing string 401 to drill out the stage tool 440 and the ball seat 430 before forming the next section of wellbore 482, as illustrated in FIG. 27.

Alternatively, the expandable portion 403 is expanded further using a mechanical expansion tool. Suitable expansion tools include a swage type expansion tool, a roller type expansion tool, and a compliant cone expansion tool. An exemplary compliant cone expansion tool is disclosed in a U.S. patent application entitled "Compliant Cone For Solid Liner Expansion" filed by Luke, et al. on Jul. 14, 2005, which application is assigned to the same assignee as the present application and is incorporated herein in its entirety. An exemplary compliant cone expansion tool includes an inner mandrel and a plurality of cone segments disposed around the inner mandrel. The cone segments are movable in a radial direction between an extended position and a retracted position in response to restrictions or obstructions encountered during expansion. An example of a roller type expander device is shown in U.S. Pat. No. 6,457,532, which patent is incorporated by reference herein in its entirety. U.S. Pat. No. 6,457,532 also shows a roller type expander having compliant characteristics that allow it to "form fit" an expandable pipe to an irregular surrounding surface such as that formed by a wellbore. Such form fitting ensures better sealing characteristics between the outer surface of the pipe and the surrounding surface.

Alternatively, multiple extrudable ball seats may be used to perform the various steps of the process. In this respect, different sized balls may be placed into the casing string to land in a respective ball seat such that the ball seats may be sequentially utilized. An exemplary application of multiple ball seats is shown in U.S. Patent Application No. 2004/0221997, which application is herein incorporated by reference in its entirety. It is also contemplated that the ball seats and the dart seats are interchangeable. Additionally, stage tools and the port collars are interchangeable with each other and with other types of selectively actuatable fluid circulation tools known to a person of ordinary skill in the art. The selectively actuatable fluid circulation tools, including the stage tool, the port collar, and the flapper valve, may be used alone or in combination for sequential or simultaneous activation. Additionally, the fluid circulation tools may be disposed below the expandable portion separately from or integrated with the shoe. The casing string may also contain multiple portions of expandable portions to seal off multiple sections of the casing string.

In another embodiment, an expandable barrier having a drill shoe disposed at a lower end thereof may include a motor to rotate the drill shoe. The motor may be actuated to rotate the drill shoe without having to rotate the entire string of casing. A casing latch may be used to couple the motor and the drill shoe to casing string. After drilling, the latch, the motor, and the drill shoe may be retrieved. An exemplary casing latch is disclosed in U.S. Patent Application Publication No. 2004/0216892, which application is assigned to same assignee of the present application and is herein incorporated by reference in its entirety.

In another embodiment, a method for creating and testing an annular barrier includes drilling a wellbore; lowering a tubular into the wellbore, the tubular including an expandable portion proximate a lower end thereof; expanding the expandable portion into a substantially sealing engagement with the wellbore; and supplying cement through a selectively actuatable fluid circulation tool.

In another embodiment, a method for creating and testing an annular barrier in a wellbore includes positioning a tubular having an expandable portion in the wellbore, the expandable portion having a non-circular cross-section; applying a first pressure to expand the expandable portion into sealing engagement with the wellbore; supplying cement through a selectively actuatable fluid circulation tool; applying a second pressure to a first side of the sealing engagement between expandable portion and the wellbore; and monitoring a second side of the sealing engagement for a change in pressure.

In one or more of the embodiments disclosed herein, the method further comprises applying a pressure to a first side of the sealing engagement between expandable portion and the wellbore and monitoring a second side of the sealing engagement for a change in pressure.

In one or more of the embodiments disclosed herein, the selectively actuatable fluid circulation tool is selected from the group consisting of a port collar, a stage tool, a flapper valve, and combinations thereof.

In one or more of the embodiments disclosed herein, the expandable barrier is provided with a plurality of selectively actuatable fluid circulation tools.

In one or more of the embodiments disclosed herein, the method further comprises closing off fluid communication through the tubular.

In one or more of the embodiments disclosed herein, expanding the expandable portion comprises exerting fluid pressure on the expandable portion.

In one or more of the embodiments disclosed herein, expanding the expandable portion comprises exerting fluid pressure on the expandable portion.

In one or more of the embodiments disclosed herein, expanding the expandable portion comprises contacting an expansion tool with the expandable portion.

In one or more of the embodiments disclosed herein, the expansion tool comprises a roller expander, a cone expander, a compliant expansion tool, a non-compliant expansion tool, and combinations thereof.

In one or more of the embodiments disclosed herein, drilling the wellbore comprises providing the tubular with an earth removal member and rotating the earth removal member to drill the wellbore.

In one or more of the embodiments disclosed herein, the earth removal member is selected from the group consisting of an expandable bit, a reamer, a drill bit, and combinations thereof.

In one or more of the embodiments disclosed herein, expanding the expandable portion occurs before cementing.

In one or more of the embodiments disclosed herein, cementing occurs before expanding the expandable portion.

In one or more of the embodiments disclosed herein, expanding the expandable portion comprises exerting mechanical pressure on the expandable portion.

In one or more of the embodiments disclosed herein, expanding the expandable portion comprises unfolding the expandable portion.

In one or more of the embodiments disclosed herein, expanding the expandable portion further comprises expanding the expandable portion such that the overall perimeter of the expandable portion is increased.

While the foregoing is directed to embodiments of the present invention, other and further embodiments of the invention may be devised without departing from the basic scope thereof, and the scope thereof is determined by the claims that follow.

We claim:

1. A method for creating and testing an annular barrier, comprising:

drilling a wellbore;

lowering a tubular into the wellbore while drilling the wellbore, the tubular including an expandable portion proximate a lower end thereof;

closing off fluid communication through the lower end of the tubular after the tubular is lowered into the wellbore;

expanding the expandable portion into sealing engagement with the wellbore;

supplying cement through the lower end of the tubular and into an annular area formed between the wellbore and the tubular;

applying a pressure to a first side of the sealing engagement between the expandable portion and the wellbore; and monitoring a second side of the sealing engagement for a change in pressure.

2. The method of claim 1, wherein the cement is supplied through the lower end of the tubular and into the annular area prior to expanding the expandable portion.

3. The method of claim 1, further comprising supplying cement through a selectively actuatable fluid circulation tool that is selected from the group consisting of a port collar, a stage tool, a flapper valve, and combinations thereof.

4. The method of claim 3, wherein expanding the expandable portion comprises exerting fluid pressure on the expandable portion.

5. The method of claim 1, wherein expanding the expandable portion comprises exerting fluid pressure on the expandable portion.

6. The method of claim 1, wherein expanding the expandable portion comprises contacting an expansion tool with the expandable portion.

7. The method of claim 6, wherein the expansion tool comprises a roller expander, a cone expander, a compliant expansion tool, a non-compliant expansion tool, and combinations thereof.

8. The method of claim 1, wherein drilling the wellbore comprises:

providing the tubular with an earth removal member; and rotating the earth removal member to drill the wellbore.

9. The method of claim 8, wherein the earth removal member is selected from the group consisting of an expandable bit, a reamer, a drill bit, and combinations thereof.

10. The method of claim 1, wherein expanding the expandable portion comprises exerting mechanical pressure on the expandable portion.

11. The method of claim 1, wherein expanding the expandable portion comprises unfolding the expandable portion.

12. The method of claim 11, wherein expanding the expandable portion further comprises expanding the expandable portion such that the overall perimeter of the expandable portion is increased.

13. The method of claim 1, wherein the tubular comprises casing or liner.

14. The method of claim 1, further comprising applying pressure to the first side of the sealing engagement between the expandable portion and the wellbore and monitoring the second side of the sealing engagement for change in pressure prior to curing of the cement.

15. A method for creating and testing an annular barrier in a wellbore, comprising:

positioning a tubular having an expandable portion in the wellbore;

applying a first pressure to expand the expandable portion into sealing engagement with the wellbore;

supplying cement through a selectively actuatable fluid circulation tool and into an annular area surrounding the expandable portion;

applying a second pressure to a first side of the sealing engagement between the expandable portion and the wellbore; and monitoring a second side of the sealing engagement for a change in pressure.

16. The method of claim 15, wherein the selectively actuatable fluid circulation tool comprises a port collar.

17. The method of claim 16, further comprising opening a port in the port collar for supplying the cement into the annular area.

18. The method of claim 17, wherein the port is opened by inserting an inner string having a port collar opening tool and a stinger into the tubular.

19. The method of claim 18, further comprising closing the port and reverse circulating to remove excess cement.

20. The method of claim 19, further comprising opening a circulation valve in the inner string to release a fluid in the inner string.

21. The method of claim 15, wherein the selectively actuatable fluid circulation tool comprises a float collar.

22. The method of claim 21, further comprising coupling an inner string to the float collar.

23. The method of claim 21, wherein the float collar includes a flapper valve.

24. A method for creating and testing an annular barrier in a wellbore, comprising:

positioning a tubular having an expandable portion in the wellbore, the expandable portion having a non-circular cross-section;

applying a first pressure to expand the expandable portion into sealing engagement with the wellbore;

supplying cement through a selectively actuatable fluid circulation tool, wherein the selectively actuatable fluid circulation tool comprises a port collar;

opening a port in the port collar for supplying the cement into an annulus, wherein the port is opened by inserting an inner string having a port collar opening tool and a stinger into the tubular;

closing the port and reverse circulating to remove excess cement;

applying a second pressure to a first side of the sealing engagement between the expandable portion and the wellbore; and monitoring a second side of the sealing engagement for a change in pressure.

25. A method for creating and testing an annular barrier in a wellbore, comprising:

positioning a tubular having an expandable portion in the wellbore, wherein the tubular includes a float collar disposed above the expandable potion and an inner string defining an annular area between the inner string and the expandable portion that is pre-filled with a fluid;

supplying cement through the float collar and into the wellbore;

applying a first pressure to expand the expandable portion into sealing engagement with the wellbore;

closing fluid communication through the float collar after expanding the expandable portion to keep a collapse pressure off of the expanded expandable portion;

applying a second pressure to a first side of the sealing engagement between the expandable portion and the wellbore; and monitoring a second side of the sealing engagement for a change in pressure.

26. The method of claim 25, further comprising supplying cement into the wellbore prior to expanding the expandable portion.

27. The method of claim 25, further comprising closing fluid communication through a lower end of the tubular prior to expanding the expandable portion.

28. The method of claim 25, further comprising lowering the tubular into the wellbore while drilling the wellbore.

* * * * *